US005728513A

United States Patent [19]

Okusa et al.

[11] Patent Number: 5,728,513

[45] Date of Patent: Mar. 17, 1998

[54] SILVER HALIDE COLOR PHOTOGRAPHIC LIGHT SENSITIVE MATERIAL

[75] Inventors: Hiroshi Okusa; Yasuhiko Kawashima, both of Hino, Japan

[73] Assignee: Konica Corporation, Tokyo, Japan

[21] Appl. No.: 604,917

[22] Filed: Feb. 22, 1996

[30] Foreign Application Priority Data

Feb. 28, 1995 [JP] Japan ..... 7-064780
Feb. 28, 1995 [JP] Japan ..... 7-064781

[51] Int. Cl.[6] ..... G03C 1/12; G03C 1/34

[52] U.S. Cl. ..... 430/505; 430/553; 430/554; 430/555; 430/585; 430/588

[58] Field of Search ..... 430/505, 553, 430/554, 555, 585, 588

[56] References Cited

U.S. PATENT DOCUMENTS

| | | | |
|---|---|---|---|
| 4,904,579 | 2/1990 | Mihayashi et al. | 430/555 |
| 4,914,007 | 4/1990 | Fujita et al. | 430/372 |
| 4,970,141 | 11/1990 | Ikegawa et al. | 430/585 |
| 5,376,519 | 12/1994 | Merkel et al. | 430/546 |
| 5,491,054 | 2/1996 | Jain et al. | 430/555 |

FOREIGN PATENT DOCUMENTS

| | | | |
|---|---|---|---|
| 0 367 540 A2 | 5/1990 | European Pat. Off. . | |
| 0 690 344 A1 | 6/1996 | European Pat. Off. . | |
| 2195661 | 8/1987 | Japan | 430/555 |
| 1252956 | 10/1989 | Japan | 430/588 |
| 3167548 | 7/1991 | Japan | 430/588 |

*Primary Examiner*—Thorl Chea
*Attorney, Agent, or Firm*—Frishauf, Holtz, Goodman, Langer & Chick, P.C.

[57] ABSTRACT

A silver halide color photographic light sensitive material is disclosed, comprising a support having thereon a silver halide emulsion layer containing a sensitizing dye represented by formula (I) and a coupler represented by formula (M-I). The photographic material further contains a coupler represented by formula (C-I) or (C-II).

Formula (I)

Formula (M-I)

Formula (C-I)

Formula (C-II)

8 Claims, No Drawings

SILVER HALIDE COLOR PHOTOGRAPHIC LIGHT SENSITIVE MATERIAL

FIELD OF THE INVENTION

The present invention related to a spectrally sensitized silver halide color photographic light sensitive material, in particular, to a silver halide color photographic light sensitive material excellent in processing stability and with enhanced spectral sensitivity in a green-light wavelength region.

BACKGROUND OF THE INVENTION

Recently, demands for performance of a silver halide color photographic light sensitive material increasingly become severe, resulting in still higher level of requirements for photographic characteristics such as sensitivity, fog and graininess and storage stability. Particularly, with the recent spread of a compact camera and lens-attached film employed as a camera for a single use, enhancement of sensitivity of a photographic light sensitive material becomes indispensable. Recently, furthermore, a compact automatic processor, so-called mini-lab spreads rapidly. In such a processor, control of processing solutions is often insufficient so that high processability is required for providing stably high quality prints.

In a silver halide color photographic light sensitive material, subtractive primaries are employed and a color image is formed by the combination of three dyes derived from a yellow coupler, magenta coupler and cyan coupler. As magenta couplers used in the silver halide color photographic light sensitive material, there have been known pyrazolone, pyrazolinobenzimidazole or indanone type couplers. Among these, there have been widely used various 5-pyrazolone derivatives, as described in U.S. Pat. Nos. 2,439,098, 2,369,489, 3,558,319, 2,311,081 and 3,677,764, British Patent No. 1,173,513 and JP-A 52-80027.

However, it has become apparent that a photographic material containing the pyrazolone type coupler has such a problem that the photographic performance thereof is liable to be varied during long term storage after the manufacture thereof.

A naphthooxazolocarbocyanine is described in Japanese Patent examine No. 61-80235, JP-a 5-341453, 2-90151, 63-80237, 60-108838, 61-80237, 60-225146, 60-128433, 60-128432, 59-185330, 59-149346, 59-116646 and 59-78338.

To make improvements in color formation and aging stability of a green-sensitive layer, there is disclosed a technique of combining a pyrazoloazole type coupler with the naphthooxazolocarbocyanine in JP-A 63-291057. These prior arts, however, still had a problem regarding processing stability of the photographic material.

As can be seen from the foregoing, the prior arts have not achieved sufficiently satisfactory improvements in sensitivity, fog and processing stability of the photographic light sensitive material.

SUMMARY OF THE INVENTION

An object of the present invention is to provide a silver halide photographic light sensitive material with low fog and high sensitivity and improved in processing stability.

Inventors of the present invention found that the above object can be achieved by a silver halide color photographic light sensitive material comprising a support having thereon photographic component layers including a silver halide emulsion layer, wherein at least one of the component layers contain a spectrally sensitizing dye represented by formula (I) and a coupler represented by formula (M-I), Formula (I)

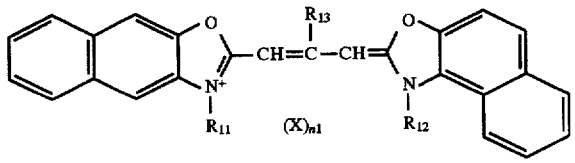

wherein $R_{11}$ and $R_{12}$ independently represent a substituted or unsubstituted alkyl group, a substituted or unsubstituted alkenyl group or a substituted or unsubstituted alkynyl group; $R_{13}$ represents a hydrogen atom, a substituted or unsubstituted alkyl group or a substituted or unsubstituted aryl group; X represents a counter ion for the balance of charge; $n_1$ represents a number necessary for balancing an overall charge of the dye molecule.

formula (M-I)

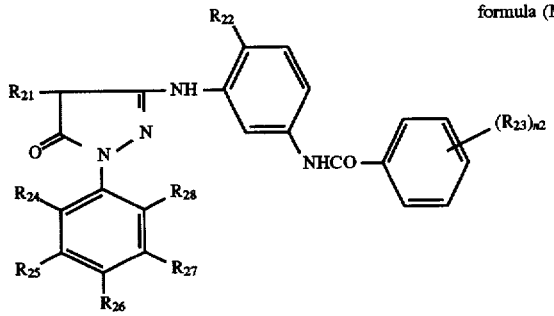

wherein $R_{21}$ represents a hydrogen atom or a substituent; $R_{22}$ represents a chlorine atom or an alkoxy group; $R_{23}$ represents a substituent; $n_2$ is an integer of 1 to 5; $R_{24}$, $R_{25}$, $R_{26}$, $R_{27}$ and $R_{28}$ independently represent a hydrogen atom or halogen atom.

Furthermore, the inventors of the present invention found that the object of the present invention can be effectively achieved in the case where at least of the component layers contains a compound represented by formula (B-I), and in formula (M-I) afore-described, $R_{21}$ is an arylthio group.

formula (B-I)

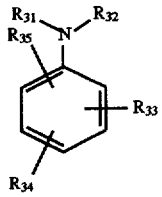

wherein $R_{31}$ and $R_{32}$ represent a hydrogen atom, alkyl group, alkenyl group, alkynyl group, aryl group or heterocyclic group; $R_{33}$, $R_{34}$ and $R_{35}$ each represent a substituent. $R_{31}$ and $R_{32}$, $R_{33}$ and $R_{34}$, or $R_{34}$ and $R_{35}$ may combine with each other to form a ring.

DETAILED DESCRIPTION OF THE INVENTION

In formula (I), an alkyl group resented by $R_{11}$ and $R_{12}$ includes methyl, ethyl, propyl, isopropyl, n-butyl, tert-butyl, n-hexyl, cyclohexyl, n-octyl and n-dodecyl. The alkyl group may be substituted by a substituent as follows.

Examples of the substituent include a alkenyl group such as a vinyl group or allyl group; an alkynyl group such as propargyl group; aryl group such as phenyl group or naphthyl group; heterocyclic group such as pyridyl group, thiazolyl group, oxazolyl group, imidazolyl group, furyl group, pyrrolyl group, pyrazinyl group, pyrimidinyl group, pyridazinyl group, selenazolyl group, sulforanyl group, piperidinyl group, pyrazolyl group or tetrazolyl group; a halogen atom such as a fluorine atom, chlorine atom, bromine atom or iodine atom; an alkoxy atom such as a methoxy group, ethoxy group, propyloxy group, n-pentyloxy group, cyclopentyl group, n-hexaoxyl group, cyclohexyloxy group, n-octyloxy group or n-dodecyloxy group; an aryloxy group such as pheoxy group or naphthyloxy group; an alkoxycarbonyl group such as methyloxycarbonyl group, ethyloxycarbonyl group, n-butyloxycarbonyl group, n-octyloxycarbonyl group or n-dodecyloxycarbonyl group; an aryoxycarbonyl group such as a phenyloxycarbonyl group or naphthyloxycarbonyl group; a sulfonamide group such as methylsulfonylamino group, ethylsulfonylamino group, n-butylsulfonylamino group, n-mexylsulfonylamino group, cyclohexylamino group, n-octylsulfonylamino group, n-dodecysulfonylamino group or phenylsulfonylamino group; a sulfamoyl group such as an aminosulfonyl group, methylaminosulfonyl group, dimethylaminosulfonyl group, n-butylaminosulfonyl group, n-hexylaminosulfonyl group cyclohexylaminosulfonyl group, n-octylaminosulfonyl group, n-dodecyaminosulfonyl group, phenylaminosulfonyl group, naphthylaminosulfonyl group or 2-pyridylaminosulfonyl group; an ureido group such as a methylureido group, ethylureido group, pentylureido group, cyclohexylureido group, n-octylureido group, n=dodecylureido group, phenylureido group or 2-pyridylaminoureido group; an acyl group such as a acetyl group, ethylcarbonyl group, propylcarbonyl group, n-pentylcarbonyl group, cyclohexylcarbonyl group, n-octylcarbonyl group, 2-ethylhexylcarbonyl group, n-dodecylcarbonyl group, phenylcarbonyl group, naphthylcarbonyl, group or pyridylcarbonyl group; a carbamoyl group such as a aminocarbonyl group, methylaminocarbonyl group, dimethylaminocarbonyl group, propylaminocarbonyl group, n-pentylaminocarbonyl group, cyclohexylaminocarbonyl group, n-octylaminocarbonyl group, 2-ethylhexylaminocarbonyl group, n-dodecylaminocarbonyl group, phenylaminocarbonyl group, naphthylaminocarbonyl group or 2-pyridylaminocarbonyl group; an amido group such as a methylcarbonylamino group, ethylcarbonylamino group, dimethylcarbonylamino group, propylcarbonylamino group, n-pentylcarbonylamino group, cyclohexylcarbonylamino group, n-octylcarbonylamino group, 2-ethylhexylcarbonylamino group, dodecycarbonylamino group phenylcarbonyl amino group or naphthylcarbonylamino group; a sulfonyl group such as methylsulfonyl group, ethylsulfonyl group, n-butylsulfonyl group, cyclohexylsulfonyl group, 2ethylhexylsulfonyl group, dodecysulfonyl group, phenylsulfony group, naphthylsulfonyl group or 2-pyridylsulfonyl group; an amino group such as an amino group, ethylamino group, dimethylamino group, n-butylamino group, cyclopentylamino group, 2-ethylhexylamino group, n-dodecylamino, anilino group, naphthylamino group or 2-pyridylamino group; a cyano group; a nitro group, a carboxy group, a hydroxy group and a sulfo group.

In formula (I), the alkyl group represented by $R_{11}$ and $R_{12}$ are preferably substituted or unsubstituted one having 1 to 7 carbon atoms, more preferably, one having 1 to 4 carbon atoms. At least one of $R_{11}$ and $R_{12}$ is preferably a sulfoalkyl group or carboxyalkyl group.

As a substituted alkyl group represented by $R_{11}$ and $R_{12}$ is preferably usable, in the present invention, an alkyl group having a substituent which is capable of being dissociated in an aqueous alkaline solution, as disclosed in JP-A 5-93978 and 6-82948.

As examples of an alkenyl group represented by $R_{11}$ and $R_{12}$ are cited a vinyl group and allyl group, which may be substituted by an alkyl group or a substituent afore-described as a substituent of the alkyl group.

As an example of an alkynyl group represented by $R_{11}$ and $R_{12}$ is cited a propargyl group, which may be substituted by an alkyl group or a substituent afore-described as a substituent of the alkyl group.

$R_{13}$ represents a hydrogen atom, a substituted or unsubstituted alkyl group, or a substituted or unsubstituted aryl group. Among these is preferable a ethyl group.

$(X)n_1$ is included in the formula to denote the presence of a cation or anion, which is necessary for neutralizing an overall ionic charge of the dye. According to the necessity, $n_1$ may take an integer of 0 or more. As preferred cations are cited an organic or inorganic ammonium ion, alkali metal ion and alkali earth metal ion. As anions are cited a halide ion, substituted aryl sulfonate ion, alkylsulfate ion, thiocyanate ion, perchlorate ion and tetrafluoroborate ion. Accordingly, $n_1$ is preferably a number of 0, 1/2 or 1 and more preferably, 0 or 1.

The spectral sensitizing dye used in the present invention can be synthesyzed in accordance with methods as described in F. M. Hamer, "Heterocyclic Compounds-Cyanine Dyes and Related Compounds" Chapters 4, 5 and 6, pages 86–119, John-Wirey and Sons (1964); and D. M. Sturmer, "Heterocyclic Compounds-Special Topics in Heterocyclic Chemistry", Chapter 8, pages 482–515, John-Wirey and Sons (1977).

Examples of the sensitizing dye used in the present invention, as represented by formula (I) will be shown as below, but the present invention is not limited thereto.

Formula (I)

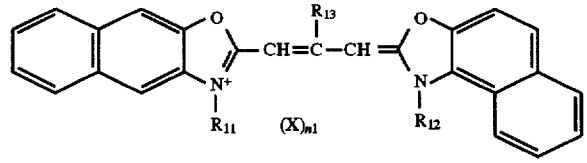

| No. | $R_{11}$ | $R_{12}$ | $R_{13}$ | $(X)_{n1}$ |
|---|---|---|---|---|
| I-1 | $CH_3$ | $(CH_2)_3SO_3^-$ | H | — |
| I-2 | $CH_3$ | $(CH_2)_3SO_3^-$ | $CH_3$ | — |

-continued

Formula (I)

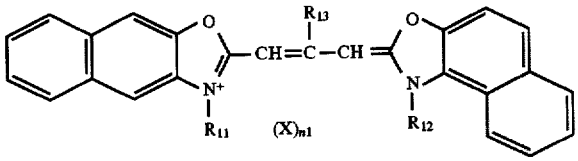

| No. | $R_{11}$ | $R_{12}$ | $R_{13}$ | $(X)_{n1}$ |
|---|---|---|---|---|
| I-3 | $CH_3$ | $(CH_2)_3SO_3^-$ | $C_2H_5$ | — |
| I-4 | $CH_3$ | $(CH_2)_3SO_3^-$ | 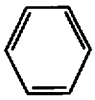 | — |
| I-5 | $C_2H_5$ | $(CH_2)_3SO_3^-$ | H | — |
| I-6 | $C_2H_5$ | $(CH_2)_3SO_3^-$ | $CH_3$ | — |
| I-7 | $C_2H_5$ | $(CH_2)_3SO_3^-$ | $C_2H_5$ | — |
| I-8 | $C_2H_5$ | $(CH_2)_3SO_3^-$ | 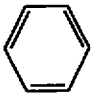 | — |
| I-9 | $(CH_2)_3SO_3^-$ | $(CH_2)_3SO_3^-$ | H | $K^+$ |
| I-10 | $(CH_2)_3SO_3^-$ | $(CH_2)_3SO_3^-$ | $CH_3$ | $Na^+$ |
| I-11 | $(CH_2)_3SO_3^-$ | $(CH_2)_3SO_3^-$ | $C_2H_5$ | $HN^+(C_2H_5)_3$ |
| I-12 | $(CH_2)_3SO_3^-$ | $(CH_2)_3SO_3^-$ | 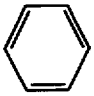 | $HN^+$ 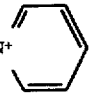 |
| I-13 | $CH_3$ | $(CH_2)_4SO_3^-$ | H | — |
| I-14 | $CH_3$ | $(CH_2)_4SO_3^-$ | $CH_3$ | — |
| I-15 | $CH_3$ | $(CH_2)_4SO_3^-$ | $C_2H_5$ | — |
| I-16 | $CH_3$ | $(CH_2)_4SO_3^-$ | 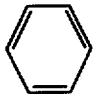 | — |
| I-17 | $C_2H_5$ | $(CH_2)_4SO_3^-$ | H | — |
| I-18 | $C_2H_5$ | $(CH_2)_4SO_3^-$ | $CH_3$ | — |
| I-19 | $C_2H_5$ | $(CH_2)_4SO_3^-$ | $C_2H_5$ | — |
| I-20 | $C_2H_5$ | $(CH_2)_4SO_3^-$ | $C_3H_7$ | — |
| I-21 | $(CH_2)_3SO_3^-$ | $(CH_2)_4SO_3^-$ | H | $K^+$ |
| I-22 | $(CH_2)_3SO_3^-$ | $(CH_2)_4SO_3^-$ | $CH_3$ | $Na^+$ |
| I-23 | $(CH_2)_3SO_3^-$ | $(CH_2)_4SO_3^-$ | $C_2H_5$ | $HN^+(C_2H_5)_3$ |
| I-24 | $(CH_2)_3SO_3^-$ | $(CH_2)_4SO_3^-$ | 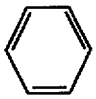 | $HN^+$ 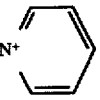 |
| I-25 | $C_2H_5$ | $-CH_2CH_2CH(SO_3^-)CH_3$ | H | — |
| I-26 | $C_2H_5$ | $-CH_2CH_2CH(SO_3^-)CH_3$ | $CH_3$ | — |
| I-27 | $C_2H_5$ | $-CH_2CH_2CH(SO_3^-)CH_3$ | $C_2H_5$ | — |
| I-28 | $C_2H_5$ | $-CH_2CH_2CH(SO_3^-)CH_3$ | 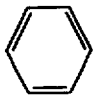 | — |
| I-29 | $C_2H_5$ | $CH_3$ | $C_2H_5$ | $Br^-$ |
| I-30 | $C_2H_5$ | $C_2H_5$ | $C_2H_5$ | $I^-$ |

-continued

Formula (I)

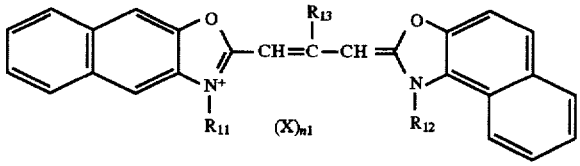

| No. | $R_{11}$ | $R_{12}$ | $R_{13}$ | $(X)_{n1}$ |
|---|---|---|---|---|
| I-31 | $CH_3$ | $(CH_2)_2SO_3^-$ | H | — |
| I-32 | $CH_3$ | $(CH_2)_2SO_3^-$ | $CH_3$ | — |
| I-33 | $CH_3$ | $(CH_2)_2SO_3^-$ | $C_2H_5$ | — |
| I-34 | $CH_3$ | $(CH_2)_2SO_3^-$ | $C_3H_7$ | — |
| I-35 | $C_2H_5$ | $(CH_2)_2SO_3^-$ | H | — |
| I-36 | $C_2H_5$ | $(CH_2)_2SO_3^-$ | $CH_3$ | — |
| I-37 | $C_2H_5$ | $(CH_2)_2SO_3^-$ | $C_2H_5$ | — |
| I-38 | $C_2H_5$ | $(CH_2)_2SO_3^-$ | 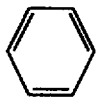 | — |
| I-39 | $C_3H_7$ | $(CH_2)_3SO_3^-$ | $C_2H_5$ | — |
| I-40 | $CH_2COOH$ | $(CH_2)_2SO_3^-$ | H | — |
| I-41 | $CH_2COOH$ | $(CH_2)_2SO_3^-$ | $CH_3$ | — |
| I-42 | $CH_2COOH$ | $(CH_2)_2SO_3^-$ | $C_2H_5$ | — |
| I-43 | $CH_2COOH$ | $(CH_2)_2SO_3^-$ | 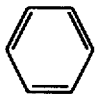 | — |
| I-44 | $(CH_2)_4SO_3^-$ | $(CH_2)_2SO_3^-$ | H | $K^+$ |
| I-45 | $(CH_2)_4SO_3^-$ | $(CH_2)_2SO_3^-$ | $CH_3$ | $Na^+$ |
| I-46 | $(CH_2)_4SO_3^-$ | $(CH_2)_2SO_3^-$ | $C_2H_5$ | $HN^+(C_2H_5)$ |
| I-47 | $C_2H_5$ | $(CH_2)_5SO_3^-$ | $C_2H_5$ | — |
| I-48 | $(CH_2)_2OH$ | $(CH_2)_4SO_3^-$ | $C_2H_5$ | — |
| I-49 | $C_2H_4OC_2H_5$ | $CH_2SO_2NHCH_3$ | $C_2H_5$ | 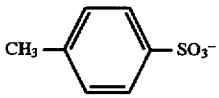 |
| I-50 | 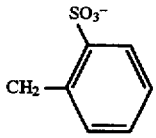 | $(CH_2)_3SO_3^-$ | $C_2H_5$ | Na+ |

The sensitizing dye above described may be used in combination with another dye or a super-sensitizer. A sensitizing dye which can be used in combination with the dye relating to the present invention is preferably a cyanine dye.

As a super-sensitizer which can be used in combination with the sensitizing dye relating to the invention, are preferably usable a styryl compound and hemicyanine compound as disclosed in JP-A 3-219233 and Japanese Patent Application No. 5-225511.

An addition amount of the sensitizing dye is preferably $2\times10^{-6}$ to $1\times10^{-2}$, more preferably $5\times10^{-6}$ to $5\times10^{-3}$ mol per mol of silver halide.

The sensitizing dye can be added to a silver halide emulsion in accordance with the method well-known in the art. The sensitizing dye, for example, can be directly dispersed in the silver halide emulsion in the form of solid particles; the dye is dissolved in water-miscible solvent such as pyridine, ethanol, methylcellosolve, fluoronated alcohol or a mixture thereof and the dye can be added to the emulsion in the form of a solution.

The sensitizing dye is dissolved in a volatile organic solvent, the solution thereof is dispersed in hydrophilic colloid and the resulting dispersion may be added to the emulsion, as described in U.S. Pat. No. 3,469,987. A sparingly water-soluble dye is dispersed in an aqueous medium, without being dissolved, and the dispersion may be added to the emulsion.

The sensitizing dye used in the invention, represented by formula (I) can be added to the emulsion at any time from the time of forming silver halide grains to the time immediately before coating the emulsion on a support. The dye may be added separatedly. The dye is added preferably at the time of forming silver halide grains or chemical-ripening, thus at the time prior to preparing a coating solution.

The sensitizing dye represented by formula (I) may be contained in any one of photographic component layers, and it is preferably contained in a green-sensitive silver halide emulsion layer. In the case where being comprised of plural green-sensitive emulsion layers, the dye may be contained in any one of the layers or plural layers. It may be contained in the green-sensitive layer and another component layer, and/or another color-sensitive layer.

The photographic component layer in the invention is referred to a hydrophilic colloidal layer provided on a support. The hydrophilic colloidal layer is classified into a light-sensitive silver halide emulsion layer and a light-insensitive layer. The former includes a silver halide emulsion layer which is spectrally sensitized with respect to light within a specified wavelength range. It is conventionally referred to a blue-sensitive silver halide emulsion layer (hereinafter, denoted as blue-sensitive layer), a green-sensitive silver halide emulsion layer (hereinafter, denoted as green-sensitive layer) or a re-sensitive silver halide emulsion layer (hereinafter, denoted as red-sensitive layer). The latter includes a protective layer for a silver halide emulsion layer, a filter layer, an interlayer and an antihalation layer. The light sensitive silver halide emulsion layer may comprise a single layer or plural layers according to the object thereof.

A magenta coupler represented by formula (M-I) will be explained as below. $R_{21}$ represents a hydrogen atom or a substituent. Examples of the substituent includes an arylthio group such as phenylthio, carboxylpropylthio group and octylthio group. Among these is preferable an arylthio group such as phenylthio in view of its color formation. More preferably, the phenylthio group has an acylamino group at an ortho-position to a sulfur atom within the group.

$R_{22}$ represents a chlorine atom or alkoxy group. Examples of the alkoxy group include a methoxy group, ethoxy group, isopropyloxy group, t-butyloxy group and n-hexyloxy group.

$R_{23}$ represents an univalent substituent. In the case where $n_2$ is two or more, $R_{23}$ may be two or more different groups.

Examples of $R_{23}$ include an alkyl group such as methyl, isopropyl or trifluoromethyl, an alkoxy group such as methoxy or ethoxy, an aryloxy group such as phenoxy, a halogen atom such as a fluorine atom, chlorine atom, bromine atom or iodine atom, a nitro group, a dimethylamino group, alkylamino group.

At least one of $R_{23}$ is preferably located at the ortho-position to the substitution position of NHCO group so as to lower density dependence of the spectral absorption of the dye.

$n_2$ is preferably an integer of 1 to 5.

$R_{24}$, $R_{25}$, $R_{26}$, $R_{27}$ and $R_{28}$ represent a hydrogen atom, fluorine atom, chlorine atom, bromine atom or iodine atom; and $R_{24}$, $R_{25}$, $R_{26}$, $R_{27}$ and $R_{28}$ is preferably a chlorine atom from the point that the spectral absorption of the dye becomes desirable with respect to the wavelength and a raw material is commercially available at a relatively low price.

Examples of the magenta coupler represented by formula (M-I) are shown as below, but the present invention is not limited thereto.

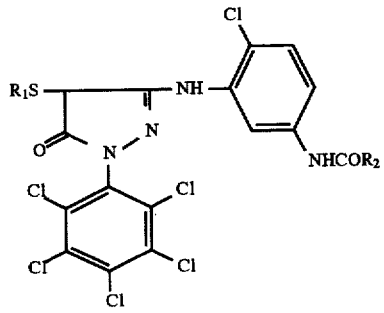

| No. | $R_1$ | $R_2$ |
|---|---|---|
| M-1 | 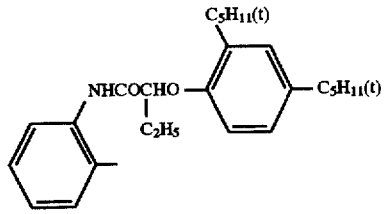 | 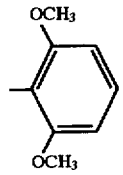 |
| M-2 | 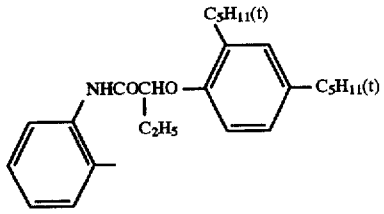 | 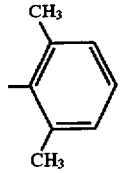 |

-continued
M-3
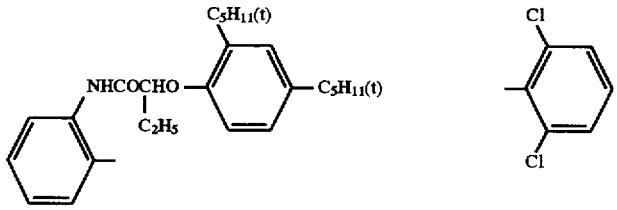
M-4
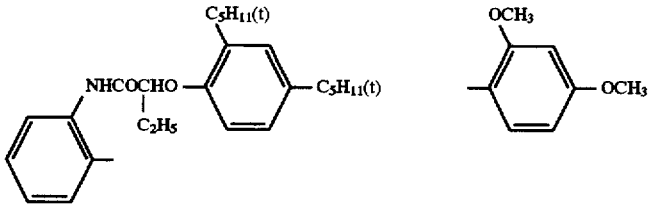
M-5
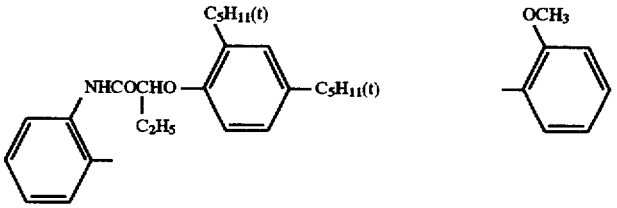
M-6
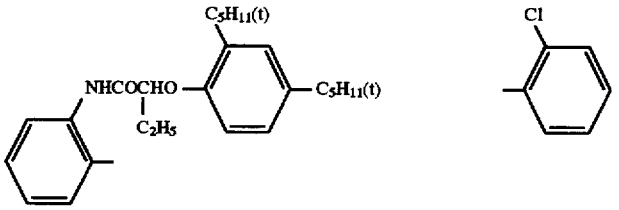
M-7
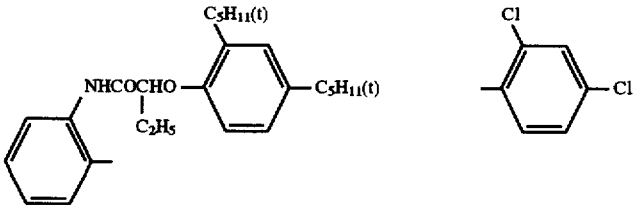
M-8
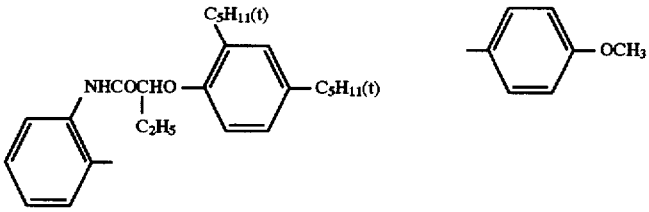
M-9
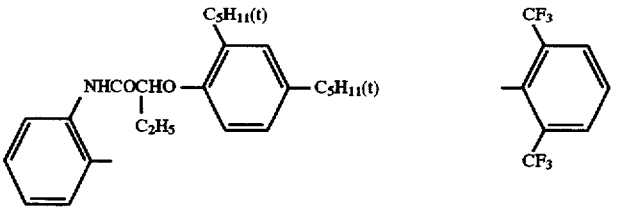

-continued
M-10
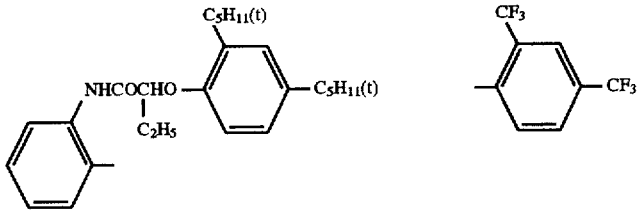
M-11
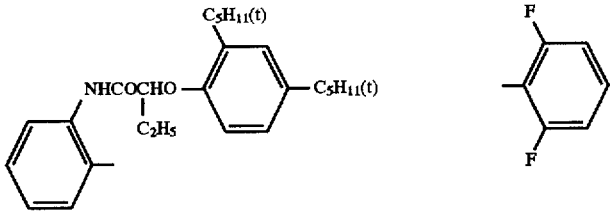
M-12
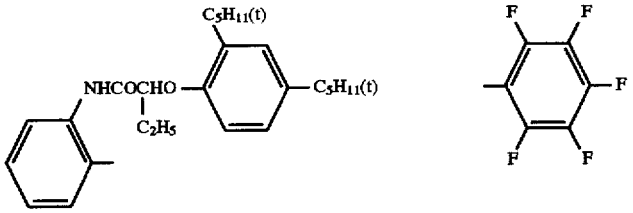
M-13
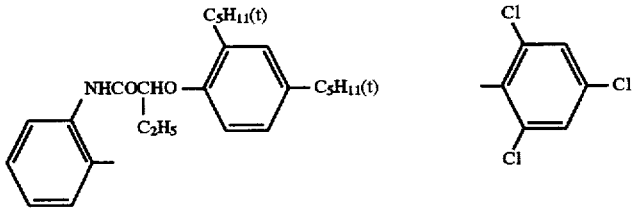
M-14
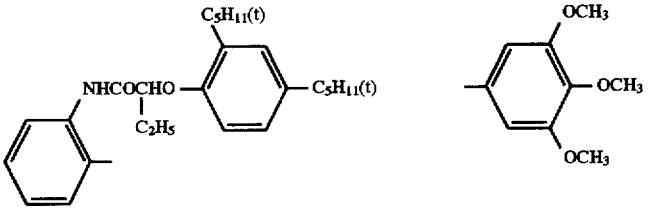
M-15
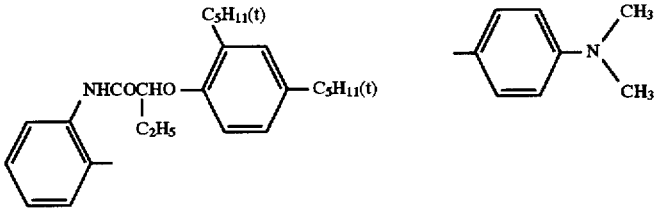
M-16
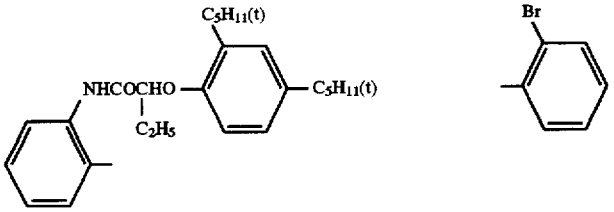

-continued
M-17
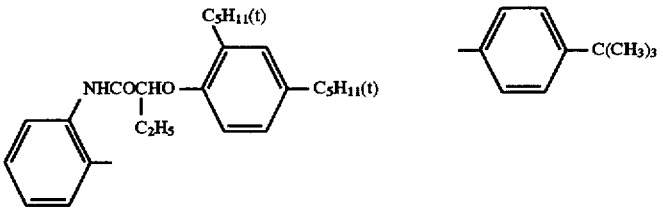
M-18
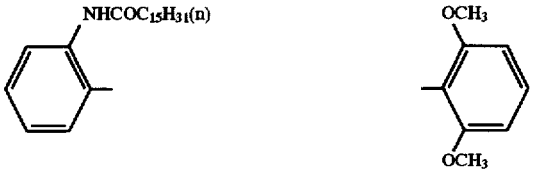
M-19
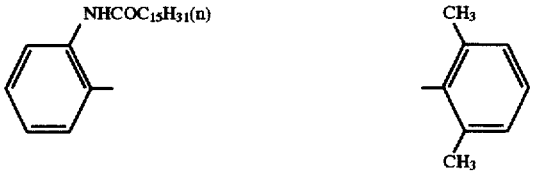
M-20
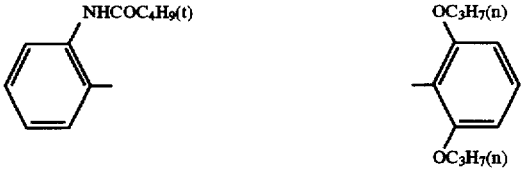
M-21
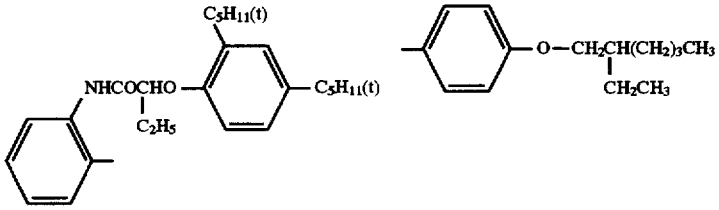
M-22
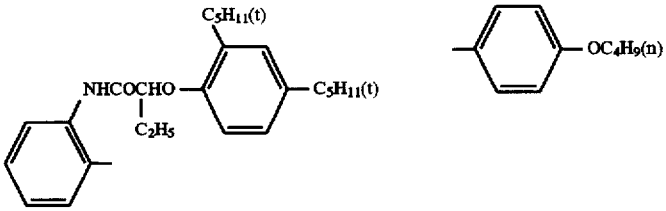
M-23
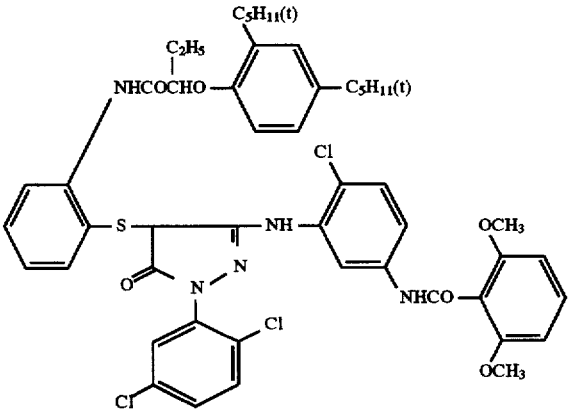

-continued
M-24
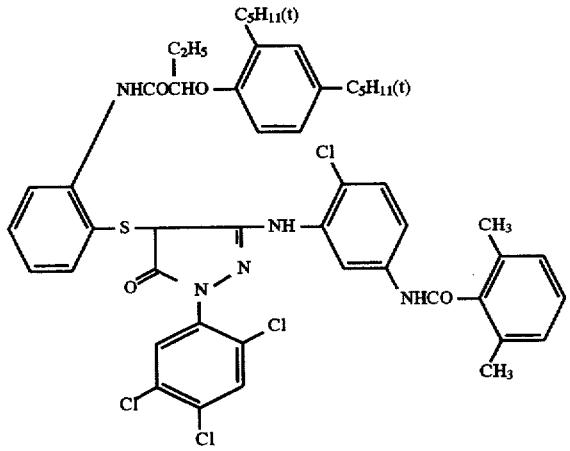
M-25
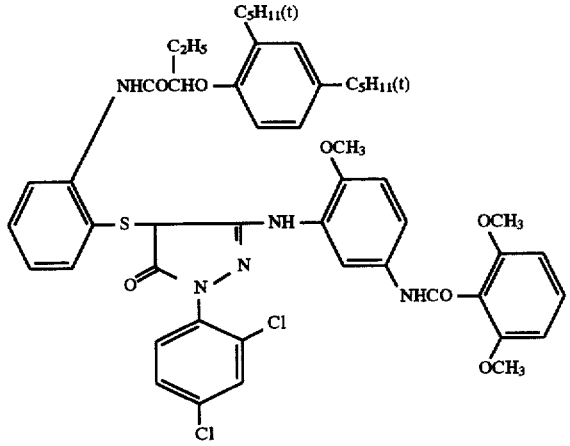
M-26
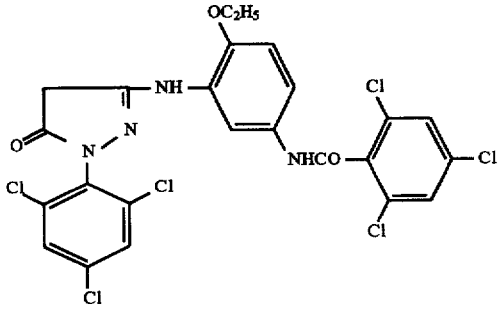
M-27
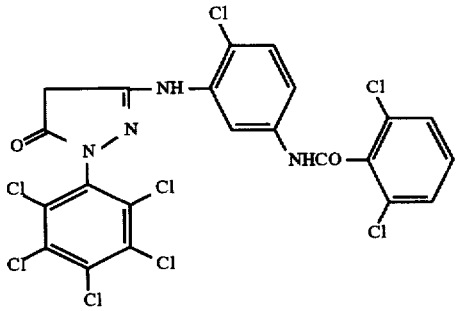
The coupler of the invention can be used in combination with a coupler which does not fall within the scope of the invention. The coupler of the invention may be used in an amount of $1\times10^{-3}$ to 1, preferably $1\times10^{-2}$ to $8\times10^{-1}$ mol per mol of silver halide.

The coupler represented by formula (M-I) can be incorporated in a photographic material according to various dispersion methods as well-known in the art. The coupler is, for example, dissolved in a high boiling solvent having a boiling point of 175° C. or higher such as tricresyl phosphate or dibutyl phthalate, a low boiling solvent such as butyl acetate or butylpropionate, or in a mixture thereof; then, the resulting solution is mixed with an aqueous gelatin solution containing a surfactant to be emulsified with a high-speed rotating mixer or colloid mill and the emulsion is added into a silver halide emulsion.

The coupler represented by formula (M-I) may be contained in a layer which is the same as or different from a layer containing a silver halide emulsion spectrally sensitized by the sensitizing dye of the invention, and it is preferably contained in the same layer.

In the present invention, furthermore, at least one of the component layers contains a cyan coupler represented by the following formula (C-I) or (C-II).

Formula (C-I)

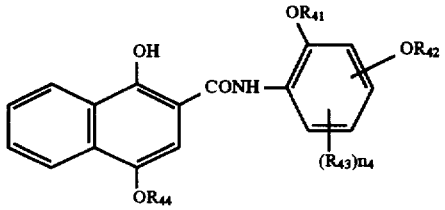

In the formula, $R_{41}$ and $R_{42}$ each represent an aliphatic group, provided that the total number of carbon atoms of $R_{41}$ and $R_{42}$ is 8 or more; $R_{43}$ represents a substituent; $n_4$ is 0 or 1; $R_{44}$ represents an aliphatic group, aromatic group or heterocyclic group.

Formula (C-II)

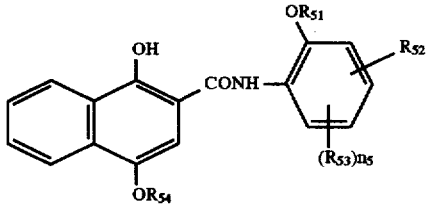

In the formula, $R_{51}$ and $R_{52}$ each represent an aliphatic group, provided that the total number of carbon atoms of $R_{51}$ and $R_{52}$ is 8 or more; $R_{53}$ represents a substituent; $n_5$ is 0 or 1; $R_{54}$ represents an aliphatic group, aromatic group or heterocyclic group.

Next, detailed description will be provided with respect to the cyan coupler represented by formula (C-I).

As an aliphatic group represented by $R_{41}$ and $R_{42}$ is cited a straight chained, branched or cyclic alkyl, alkenyl or alkynyl group. These groups each may be substituted.

The aliphatic group represented by $R_{41}$ is preferably an alkyl group having 4 to 20 carbon atoms, including a butyl group, isobutyl group, pentyl group, isopentyl group, hexyl group, cyclohexyl group, octyl group, n-ethylhexyl group, decyl group, dodecyl group, 2-methyloctyl group, 2-butyloctyl group, 2-hexyldecyl group, 5,7-dimethyloctyl group, 3,5,5-trimethylhexyl group and hexadecy group.

The aliphatic group represented by $R_{41}$ is preferably an alkyl group having 1 to 20 carbon atoms, including a methyl group, ethyl group, propyl group, isopropyl group, and the aliphatic groups exemplified in the case of $R_{41}$.

The total number of carbon atoms of $R_{41}$ and $R_{42}$ is 8 or more, preferably 10 to 32, and at least one of them is preferably a branched alkyl group.

$R_{43}$ represents a substituent. Examples of the substituent include an aliphatic group, aromatic group, halogen atom, hydroxy group, amino group, carboxyamino group, sulfoamido group, ureido group, acyloxy group, aliphatic-oxy group, aromatic-oxy group, aliphatic-thio group, aromatic-thio group and sulfamoylamino group.

The aliphatic group represented by $R_{44}$ is preferably a straight-chained, branched or cyclic alkyl group having 1 to 30 carbon atoms, which may be substituted, more preferably a substituted alkyl group having 2 to 30 carbon atoms. As examples of a substituent of the substituted alkyl group are cited a carboxy group, aliphatic-oxycarbonyl group, aliphatic-oxy group, aromatic-oxy group, aliphatic-thio group, sulfonyl group acyl group, carbamoyl group, sulfamoyl group, acylamino group, sulfonamido group, halogen atom, ureido group, urethane group, acyloxy group, carbamoyloxy group, hydroxy group, aromatic group, heterocyclic group, cyano group, amino group, oxalyl group and oxyamido group.

The aromatic group represented by $R_{44}$ is preferably a substituted or unsubstituted phenyl or naphthyl group, more preferably substituted phenyl group having 6 to 30 carbon atoms. As a substituent of the substituted phenyl group is cited a substituent exemplified in the substituted alkyl group above-described.

The heterocyclic group represented by $R_{44}$ is preferably a 5 or 6-membered ring containing at least one hetero atom selected from nitrogen, oxygen and sulfur or a condensed-ring thereof with an aromatic or heterocyclic ring, which may be substituted by a substituent exemplified in the substituted alkyl group above-described.

$R_{44}$ is preferably an aliphatic or aromatic group.

The compound represented by formula (C-I) is preferably a compound represented by the following formula (C-Ia).

formula (C-Ia)

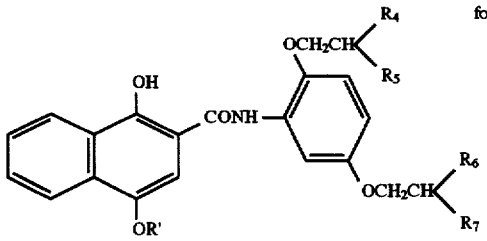

In the formula, $R_4$, $R_5$, $R_6$ and $R_7$ each represent a straight-chained or branched alkyl group, provided that the total number of carbon atoms of $R_4$ through $R_7$ is 6 to 28. R' represents a substituted alkyl group having 2 to 30 carbon atoms or a substituted phenyl group having 6 to 30 carbon atoms.

As examples of substituents of the substituted alkyl or phenyl group are cited the substituents exemplified as a substituent of the substituted alkyl group afore-described with respect to $R_{44}$ of formula (C-I).

The cyan coupler represented by formula (C-II) will be explained in detail.

As an aliphatic group represented by $R_{51}$ and $R_{52}$ is cited a straight chained, branched or cyclic alkyl, alkenyl or alkynyl group. These groups each may be substituted. The aliphatic group represented by $R_{51}$ is preferably an alkyl group having 4 to 20 carbon atoms, including a butyl group, isobutyl group, pentyl group, isopentyl group, hexyl group, cyclohexyl group, octyl group, n-ethylhexyl group, decyl group, dodecyl group, 2-methyloctyl group, 2-butyloctyl group, 2-hexyldecyl group, 5,7-dimethyloctyl group, 3,5,5-trimethylhexyl group and hexadecy group. The aliphatic group represented by $R_{52}$ is preferably an alkyl group having 2 to 20 carbon atoms, more preferably a branched or cyclic alkyl group having 4 to 20 carbon atoms, including a sec-butyl group, t-butyl group, 1,1,3,3-tetramethylbutyl group, cyclopentyl group, cyclohexyl group, 1-ethyl-1-methylpropyl group, 1-ethyl-1-methylpentyl group, 1-hexyl-1-methylnonyl group, bicyclooctyl group and adamantyl group.

The total number of carbon atoms of $R_{51}$ and $R_{52}$ is 8 or more, preferably 10 to 32.

$R_{53}$ represents a substituent. Examples of the substituent include an aliphatic group, aromatic group, halogen atom, hydroxy group, amino group, carboxyamino group, sulfoamido group, ureido group, acyloxy group, aliphatic-oxy group, aromatic-oxy group, aliphatic-thio group, aromatic-thio group and sulfamoylamino group.

The aliphatic group represented by $R_{54}$ of formula (C-II) is preferably a straight-chained, branched or cyclic alkyl group having 1 to 30 carbon atoms, which may be substituted, more preferably a substituted alkyl group having 2 to 30 carbon atoms. As examples of a substituent of the substituted alkyl group are cited a carboxy group, aliphatic-oxycarbonyl group, aliphatic-oxy group, aromatic-oxy group, aliphatic-thio group, sulfonyl group, acyl group, carbamoyl group, sulfamoyl group, acylamino group, sulfonamido group, halogen atom, ureido group, urethane group, acyloxy group, carbamoyloxy group, hydroxy group, aromatic group, heterocyclic group, cyano group, amino group, oxalyl group and oxyamido group.

The aromatic group represented by $R_{54}$ is preferably a substituted or unsubstituted phenyl or naphthyl group, more preferably substituted phenyl group having 6 to 30 carbon atoms. As a substituent of the substituted phenyl group is cited a substituent exemplified in the substituted alkyl group above-described.

The heterocyclic group represented by $R_{54}$ is preferably a 5 or 6-membered ring containing at least one hetero atom selected from nitrogen, oxygen and sulfur or a condensed-ring thereof with an aromatic or heterocyclic ring, which may be substituted by a substituent exemplified in the substituted alkyl group above-described.

$R_{54}$ is preferably an aliphatic or aromatic group.

Among compounds represented by formula (C-II) is preferable a compound represented by formula (C-IIa).

Formula (C-IIa)

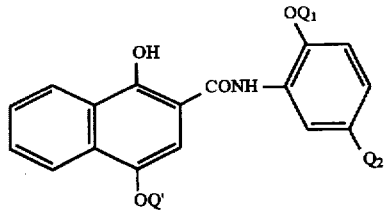

In the formula, $Q_1$ represents a straight-chained, branched or cyclic alkyl group having 4 to 20 carbon atoms such as alkyl groups exemplified in $R_{54}$; $Q_2$ represents a tertiary alkyl group having 4 to 20 carbon atoms (for example, t-butyl, 1,1,3,3-tetramethylbutyl, 1-ethyl -1-methylpentyl, 1-hexyl-1-methylnonyl, bicyclooctyl and adamantyl) or a 5 or 6-membered cyclic alkyl group (for example, cyclohexyl); Q' represents a substituted alkyl group having 2 to 30 carbon atoms or a substituted phenyl group having 2 to 30 carbon atoms.

As examples of a substituent of the substituted alkyl or phenyl group are cited substituents exemplified as those of substituted alkyl group in $R_{54}$ of formula (C-II).

Examples of the cyan coupler represented by formula (C-I) or (C-II) are shown as below.

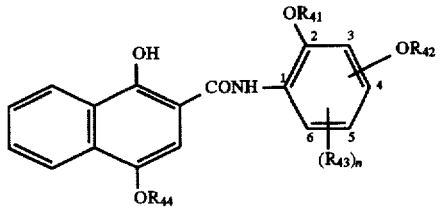

| No. | $R_{41}$ | $R_{42}$ | (n)$R_{43}$ | $R_{44}$ |
|---|---|---|---|---|
| CI-1 | $-CH_2CH(C_4H_9)(C_2H_5)$ | $5\text{-}CH_2CH(C_4H_9)(C_2H_5)$ | (0) | $-C_6H_4-NHCOCH_2CH_2COOH$ |
| CI-2 | $-CH_2CH(C_4H_9)(C_2H_5)$ | $5\text{-}CH_2CH(C_4H_9)(C_2H_5)$ | (0) | $-CH_2CONHCH_2CH_2OCH_3$ |
| CI-3 | $-CH_2CH(C_4H_9)(C_2H_5)$ | $5\text{-}CH_2CH(C_4H_9)(C_2H_5)$ | (0) | $-C_6H_4-NHCOCH(C_4H_9)(C_2H_5)$ |

-continued

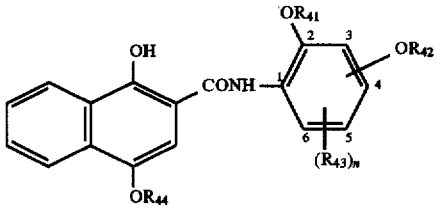

| No. | $R_{41}$ | $R_{42}$ | (n)$R_{43}$ | $R_{44}$ |
|---|---|---|---|---|
| CI-4 | $-CH_2CH(C_4H_9)(C_2H_5)$ | $5\text{-}CH_2CH(C_4H_9)(C_2H_5)$ | (0) | $-CH_2COOCH_3$ |
| CI-5 | $-CH_2CH(C_4H_9)(C_2H_5)$ | $5\text{-}CH_2CH(C_4H_9)(C_2H_5)$ | (0) | $-CH_2COOH$ |
| CI-6 | $-CH_2CH(C_4H_9)(C_2H_5)$ | $5\text{-}CH_2CH(C_4H_9)(C_2H_5)$ | (0) | $-C_6H_4-NHCOCH_2CH(C_8H_{17})COOH$ |
| CI-7 | $-CH_2CH(C_4H_9)(C_2H_5)$ | $5\text{-}CH_2CH(C_4H_9)(C_2H_5)$ | (0) | $-CH_2CH_2SCH_2COOH$ |
| CI-8 | $-CH_2CH(C_4H_9)(C_2H_5)$ | $5\text{-}CH_2CH(C_4H_9)(C_2H_5)$ | (0) | $-CH(C_{12}H_{25})COOH$ |
| CI-9 | $-CH_2CH(C_4H_9)(C_2H_5)$ | $5\text{-}CH_2CH(C_4H_9)(C_2H_5)$ | (0) | $-C_6H_4-NHSO_2CH_3$ |
| CI-10 | $-CH_2CH(C_4H_9)(C_2H_5)$ | $5\text{-}CH_2CH(CH_3)(CH_3)$ | (0) | $-C_6H_4-NO_2$ |
| CI-11 | $-CH_2CH(CH_3)(CH_3)$ | $5\text{-}CH_2CH(C_4H_9)(C_2H_5)$ | (0) | $-C_6H_4-NH_2$ |
| CI-12 | $-CH_2CH(CH_3)(CH_3)$ | $5\text{-}CH_2CH(C_4H_9)(C_6H_{13})$ | (0) | $-CH_2CH_2SCH(C_{12}H_{25})COOH$ |
| CI-13 | $-CH_2CH(CH_3)(CH_3)$ | $5\text{-}CH_2CH(C_6H_{13})(CH_3)$ | (0) | $-CH(C_{12}H_{25})COOH$ |
| CI-14 | $-CH_2CH(CH_3)(CH_3)$ | $5\text{-}CH_2CH(C_8H_{17})(C_6H_{13})$ | (0) | $-CH_2CH_2O-C_6H_4-*$<br>$*-NHCOCH(C_{18}H_{37})CH_2COOH$ |

-continued

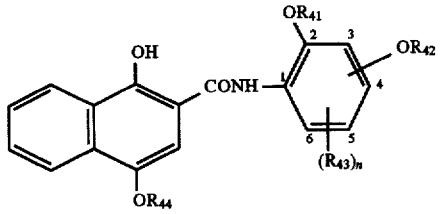

| No. | $R_{41}$ | $R_{42}$ | (n)$R_{43}$ | $R_{44}$ |
|---|---|---|---|---|
| CI-15 | $-CH_2CH(CH_3)_2$ | 5-$CH_2CH(C_6H_{13})C_4H_9$ | (0) | $-C_6H_4-SO_2CH_3$ |
| CI-16 | $-CH_2CH(C_6H_{13})CH_3$ | 5-$CH_2CH(C_4H_9)C_2H_5$ | (0) | $-CH_2CONHCH_2COOH$ |
| CI-17 | $-CH_2CH(C_6H_{13})C_4H_9$ | 5-$CH_2CH(C_4H_9)C_2H_5$ | (0) | $-C_6H_4-NHCOCH_3$ |
| CI-18 | $-CH_2CH(C_6H_{13})C_4H_9$ | 5-$CH_2CH(CH_3)CH_3$ | (0) | $-CH_2CH_2Cl$ |
| CI-19 | $-CH_2CH(C_8H_{17})C_6H_{13}$ | 5-$CH_2CH(CH_3)CH_3$ | (0) | $-CH_2COOC_{12}H_{25}$ |
| CI-20 | $-CH_2CH(C_8H_{17})C_6H_{13}$ | 5-$CH_2CH(C_8H_{17})C_6H_{13}$ | (0) | $-C_6H_4-OCH_3$ |
| CI-21 | $-CH_2CH(CH_3)CH_3$ | 5-(n)$C_{12}H_{25}$ | (0) | $-CH(CH_3)COOC_3H_7$ |
| CI-22 | -(n)$C_{12}H_{25}$ | 5-$CH_2CH(CH_3)CH_3$ | (0) | $-C_6H_4-NHCOOC_2H_5$ |
| CI-23 | $-CH_2CH(C_8H_{17})C_6H_{13}$ | 5-$CH_3$ | (0) | $-CH_2CH_2CN$ |
| CI-24 | $-CH_2CH(C_4H_9)C_2H_5$ | 4-$CH_2CH(C_4H_9)C_2H_5$ | (0) | $-C_6H_4-NHSO_2CH_3$ |
| CI-25 | $-CH_2CH(C_4H_9)C_2H_5$ | 6-$CH_2CH(C_4H_9)C_2H_5$ | (0) | $-C_6H_4-NHCOCH_2CH(C_{18}H_{37})COOH$ |

-continued

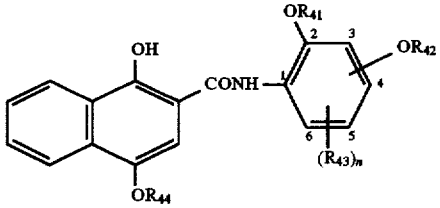

| No. | $R_{41}$ | $R_{42}$ | $(n)R_{43}$ | $R_{44}$ |
|---|---|---|---|---|
| CI-26 | $-CH_2CH(C_4H_9)(C_2H_5)$ | $6\text{-}CH_2CH(C_8H_{17})(C_6H_{13})$ | (0) | $-CH_2CH_2SCH_2COOH$ |
| CI-27 | $-CH_2CH(C_4H_9)(C_2H_5)$ | $(t)C_5H_{11}$<br>$6\text{-}CH_2CH_2O$ — * <br>*-$(t)C_5H_{11}$ | (0) | $-CH_2CONHCH_2CH_2OCH_3$ |
| CI-28 | $-CH_2CH(C_4H_9)(C_2H_5)$ | $6\text{-}CH_2CH_2OC_{12}H_{25}$ | (0) | $-CH_2CH_2CH_2COOH$ |
| CI-29 | $-CH_2CH(C_4H_9)(C_2H_5)$ | $5\text{-}CH_2CONH-*$<br>$*\text{-}(CH_2)_2OCH_3$ | (0) | $-CH_2CH_2SO_2CH_3$ |
| CI-30 | $-CH_2CH(C_4H_9)(C_2H_5)$ | $5\text{-}CH_2CH(C_4H_9)(C_2H_5)$ | (1)[1] | $CH_3O$<br>NHCONH—*<br>*—COOH |
| CI-31 | $-CH_2CH(C_4H_9)(C_2H_5)$ | $5\text{-}CH_2CH(C_4H_9)(C_2H_5)$ | (1)[2] | $CONH_2$ |
| CI-32 | $-CH_2CH(C_4H_9)(C_2H_5)$ | $5\text{-}CH_2CH(C_4H_9)(C_2H_5)$ | (1)[3] | $-CH_2CH_2OH$ |
| CI-33 | $\text{-}(n)C_6H_{13}$ | $5\text{-}(n)C_6H_{13}$ | (0) | $NHCOCOOC_2H_5$ |
| CI-34 | $-CH_3$ | $5\text{-}CH_2CH(C_8H_{17})(C_6H_{13})$ | (0) | $-CH_2CH_2COOC_4H_9$ |
| CI-35 | $-CH_2CH(C_4H_9)(C_2H_5)$ | $4\text{-}CH_2CH(C_4H_9)(C_2H_5)$ | (1)[4] | COOH |

-continued
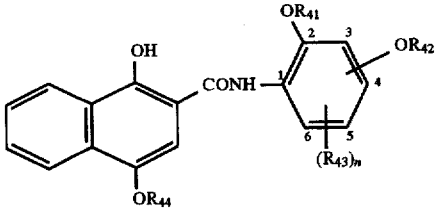
| No. | $R_{41}$ | $R_{42}$ | $(n)R_{43}$ | $R_{44}$ |
|---|---|---|---|---|
| CI-36 | $-CH_2CH(CH_3)_2$ | $5\text{-}CH_2CH(C_4H_9)(C_2H_5)$ | (0) | 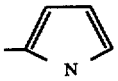 |
| CI-37 | $-CH_2CH(C_8H_{17})(C_6H_{13})$ | $5\text{-}(n)C_4H_9$ | (0) | 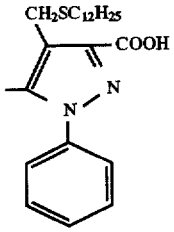 |
| CI-38 | $-CH_2CH(CH_3)_2$ | $-CH_2CH(CH_3)_2$ | (0) | 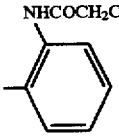 |
[1]4-$NHCOCH_3$
[2]4-$NHSO_2CH_3$
[3]4-Cl
[4]5-$(t)C_4H_9$
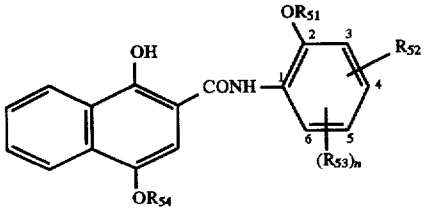
| No. | $R_{51}$ | $R_{52}$ | $(n)R_{53}$ | $R_{54}$ |
|---|---|---|---|---|
| CII-1 | $-(n)C_8H_{17}$ | $5\text{-}C(CH_3)_2-CH_2-C(CH_3)_2-CH_3$ | (0) | 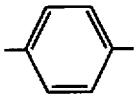 $-NHCOCH_2CH_2COOH$ |
| CII-2 | $-(n)C_8H_{17}$ | $5\text{-}C(CH_3)_2-CH_2-C(CH_3)_2-CH_3$ | (0) | $-CH_2CONHCH_2CH_2OCH_3$ |
| CII-3 | $-(n)C_8H_{17}$ | $5\text{-}C(CH_3)_2-CH_2-C(CH_3)_2-CH_3$ | (0) | $-CH_2COOCH_3$ |
| CII-4 | $-(n)C_8H_{17}$ | $5\text{-}C(CH_3)_2-CH_2-C(CH_3)_2-CH_3$ | (0) | $-CH(C_{12}H_{25})COOH$ |

-continued

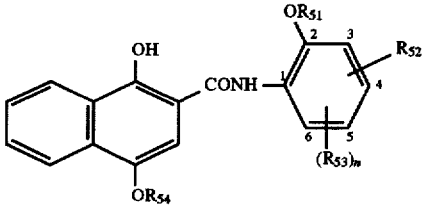

| No. | $R_{51}$ | $R_{52}$ | (n)$R_{53}$ | $R_{54}$ |
|---|---|---|---|---|
| CII-5 | -(n)$C_8H_{17}$ | $5\text{-}C(CH_3)_2-CH_2-C(CH_3)_2-CH_3$ | (0) | $-C_6H_4-NHCOCH_2CH(C_8H_{17})COOH$ |
| CII-6 | $-CH_2CH(CH_3)_2$ | $5\text{-}C(CH_3)_2-CH_2-C(CH_3)_2-CH_3$ | (0) | $-C_6H_4-NHCOCH_2CH_2COOH$ |
| CII-7 | $-CH_2CH(CH_3)_2$ | $5\text{-}C(CH_3)_2-CH_2-C(CH_3)_2-CH_3$ | (0) | $-C_6H_4-NHCOCH_2CH(C_8H_{17})COOH$ |
| CII-8 | $-CH_2CH(CH_3)_2$ | $5\text{-}C(CH_3)_2-CH_2-C(CH_3)_2-CH_3$ | (0) | $-CH_2COOCH_3$ |
| CII-9 | $-CH_2CH(CH_3)_2$ | $5\text{-}C(CH_3)_2-CH_2-C(CH_3)_2-CH_3$ | (0) | $-CH_2COOH$ |
| CII-10 | $-CH_2CH(CH_3)_2$ | $5\text{-}C(CH_3)_2-CH_2-C(CH_3)_2-CH_3$ | (0) | $-CH_2CONHCH_2CH_2OCH_3$ |
| CII-11 | -(n)$C_8H_{17}$ | $5\text{-}C(CH_3)_2-CH_2-CH_3$ | (0) | $-CH_2CH_2O-C_6H_4-*$ <br> $*-NHCOCH(C_{16}H_{33})CH_2COOH$ |
| CII-12 | -(n)$C_8H_{17}$ | $5\text{-}C(CH_3)_2-CH_3$ | (0) | $-CH(C_6H_{13})-(CH_2)_{10}-COOH$ |
| CII-13 | -(n)$C_{12}H_{25}$ | $5\text{-}C(CH_3)_2-CH_3$ | (0) | $-CH_2CH_2O-C_6H_4-NO_2$ |
| CII-14 | -(n)$C_{12}H_{25}$ | $5\text{-}C(CH_3)_2-CH_2-CH_3$ | (0) | $-CH_2COOC_{12}H_{25}$ |
| CII-15 | $-CH_2CH(C_4H_9)(C_2H_5)$ | 5-cyclohexyl | (0) | $-CH_2CH_2SO_2CH_3$ |

-continued
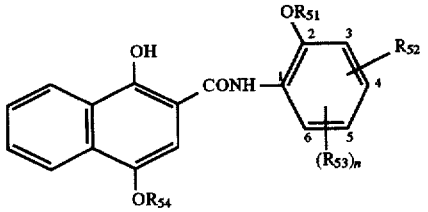
| No. | $R_{51}$ | $R_{52}$ | (n)$R_{53}$ | $R_{54}$ |
|---|---|---|---|---|
| CII-16 | $-CH_2CH(C_4H_9)(C_2H_5)$ | 5-$C(CH_3)_2-CH_2CH_2CH_2CH_3$ | (0) | $-CH_2CONHC_{12}H_{25}$ |
| CII-17 | $-CH_2CH(C_4H_9)(C_2H_5)$ | 5-$C(CH_3)_2-CH_2-C(CH_3)_2$ | (0) | 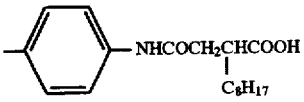 |
| CII-18 | $-CH_2CH(C_8H_{17})(C_6H_{13})$ | 5-$C(CH_3)_3$ | (0) | $-CH_2CH_2CH(COOH)C_{12}H_{25}$ |
| CII-19 | -(n)$C_{16}H_{33}$ | 5-$C(CH_3)_3$ | (0) | $-CH_2CH_2SCH(C_{12}H_{25})COOH$ |
| CII-20 | $-CH_2CH(CH_3)_2$ | 5-$C(CH_3)_2-CH_2CH_3$ | (1)[1] | 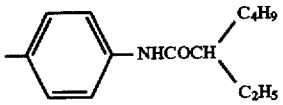 |
| CII-21 | -(n)$C_8H_{17}$ | 5-$C(CH_3)_2-CH_2-C(CH_3)_2$ | (0) | 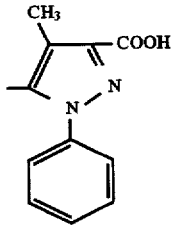 |
| CII-22 | -(n)$C_{18}H_{37}$ | 4-$C(CH_3)_3$ | (0) | $-CH_2CH_2NHSO_2C_8H_{17}$ |
| CII-23 | $-CH_2CH(C_8H_{17})(C_6H_{13})$ | 5-$C_5H_5$ | (0) | 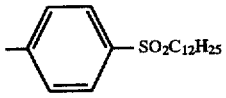 |
| CII-24 | $-CH_2CH(C_8H_{17})(C_6H_{13})$ | 3-$C_5H_5$ | (0) | 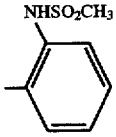 |

-continued
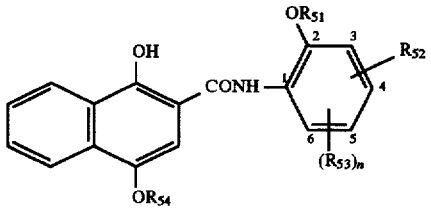
| No. | $R_{51}$ | $R_{52}$ | (n)$R_{53}$ | $R_{54}$ |
|---|---|---|---|---|
| CII-25 | -(n)$C_6H_{13}$ | 5-C(CH3)2-CH2CH3 | (1)[2] | CH3O, NHCONH—*, *—COOH |
| CII-26 | -(n)$C_6H_{13}$ | 5-C(CH3)2-CH2CH3 | (1)[3] | COO—, —COOH, —NO2 |
| CII-27 | —CH(C2H5)2 | 5-C(CH3)2-CH2-C(CH3)2 | (0) | NHCOCH2CH2COOH |
| CII-28 | —CH(C2H5)CH3 | 5-C(CH3)2-CH2-C(CH3)2 | (0) | NO2, —CH2OH |
| CII-29 | -(n)$C_4H_9$ | 5-C(CH3)2-CH2-C(CH3)2 | (0) | NHCOCH2CH2COOH |
| CII-30 | 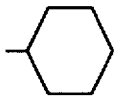 | 5-C(CH3)2-CH2-C(CH3)2 | (0) | —CH2CH2SCH2COOH |
| CII-31 | —CH(CH3)2 | 5-C(CH3)2-CH2-C(CH3)2 | (0) | —CH2CH2SCH2COOH |
| CII-32 | —CH(CH3)2 | 5-C(CH3)2-CH3 | (0) | NHCOCH2CH2COOH |
[1] 3-C(CH3)2-CH2CH3
[2] 3-NHCOCH3
[3] 3-Cl These couplers may be used in combination with another kind of coupler. The coupler may be contained in an amount of $1\times10^{-3}$ to 1, preferably $1\times10^{-2}$ to $8\times10^{-1}$ mol per mol of silver halide.

Next, a compound represented by formula (B-I) will be explained as below. In the formula, an alkyl group represented by $R_{31}$ and $R_{32}$ includes methyl, ethyl, n-propyl, tert-butyl, n-pentyl, cyclopentyl, n-hexyl, cyclohexyl, n-octyl and n-dodecyl; examples of an alkenyl group include vinyl and allyl; as an example of alkynyl group is cited propargyl; as an examples of aryl group are cited phenyl or naphthyl group; as examples of heterocyclic group are cited a pyridyl group, thiazolyl group, oxazolyl group, imidazolyl group, furyl group, pyrrolyl group, pyrazinyl group, pyrimidinyl group, pyridazinyl group, selenazolyl group, sulforanyl group, pyperidinyl group, pyrazolyl group and tetrazolyl group.

As a substituent represented by $R_{35}$, $R_{34}$ and $R_{35}$ are cited an alkyl group such as methyl, ethyl, n-propyl, isopropyl, tert-butyl, n-pentyl, cyclopentyl, n-hexyl, cyclohexyl, n-octyl or n-dodecyl; an alkenyl group such as vinyl or allyl; an alkynyl group such as propargyl; an aryl group such as phenyl or naphthyl; a heterocyclic group such as a pyridyl group, thiazolyl group, oxazolyl group, imidazolyl group, furyl group, pyrrolyl group, pyrazinyl group, pyrimidinyl group, pyridazinyl group, selenazolyl group, sulforanyl group, pyperidinyl group, pyrazolyl group or tetrazolyl group; a halogen atom such as fluorine atom, chlorine atom, bromine atom or iodine atom; an alkoxy group such as methoxy, ethoxy, propyloxy, n-pentyloxy, cyclopentyloxy, n-hexyloxy, cyclohexyloxy, n-octyloxy or n-dodecyoxy; an aryloxy group such as phenoxy or naphthyloxy; an alkoxycarbonyl group such as methyloxycarbonyl, ethyloxycarbonyl, n-butyloxycarbonyl, n-octyloxycarbonyl or n-dodecyloxycarbonyl; an aryloxycarbonyl group such as phenyloxycarbonyl or naphthyloxycarbonyl; a sulfonamide group such as methylsulfonylamino, ethysulfonylamino, n-butylsulfonylamino, n-hexylsulfonylamino, cyclohexylsulfonylamino, n-octylsulfonylamino, n-dodecylsulfonylamino or penylsulfonylamino; a sulfamoyl group such as aminosulfonyl, methylaminosulfonyl, dimethylaminosulfonyl, n-butylaminosulfonyl, n-hexylaminosulfonyl, cyclohexyaminosulfonyl, n-octylaminosulfonyl, n-dodecylaminosulfonyl, phenylaminosulfonyl; naphthylaminosulfonyl or 2-pyridylaminosulfonyl; an ureido group such as methylureido, ethylureido, pentylureido, cyclohexylureido, n-octylureido, n-dodecyureido, phenylureido, naphthylureido 2-pyridylureido; an acyl group such as acetyl, ethylcarbonyl, propylcarbonyl, n-pentylcarbonyl, cyclohexylcarbonyl , n-octylcarbonyl, 2-ethylhexylcarbonyl, n-dodecylcarbonyl, phenylcarbonyl, naphthylcarbonyl or 2-pyridylcarbonyl; a carbamoyl such as aminocarbonyl, methylaminocarbonyl, dimethylaminocarbonyl, propylaminocarbonyl, n-pentylaminocarbonyl, cyclohexylaminocarbonyl, n-octylaminocarbonyl, 2-ethylhexylaminocarbonyl, n-dodecylaminocarbonyl, phenylaminocarbonyl, naphthylaminocarbonyl, 2-pyridylaminocarbonyl; am amido group such as methylcarbonylamino, ethylcarbonylamino, dimethylcarbonylamino, propylcarbonylamino, n-pentyl cyclohexylcarbonylamino, n-octylcarbonylamino, carbonylamino, 2-ethylhexylcarbonylamino, dodecylcarbonylamino, phenylcarbonylamino or naphthylcarbonylamino; a sulfonyl group such as methylsulfonylethylsulfonyl, n-butylsulfonyl, cyclohexylsulfonyl, 2-ethylhexylsulfonyl, dodecysulfonyl, phenylsulfonyl, naphthylsulfonyl or 2-pyridylsulfonyl; a cyano group, a nitro group, a carboxy group, hydroxy group, sulfo group and hydrogen atom. An alkyl group represented by $R_{31}$ and $R_{32}$ may be substituted by a substituent aforedescribed as a substituent for analkyl group.

$R_{31}$ and $R_{32}$, $R_{33}$ and $R_{34}$, and $R_{34}$ and $R_{35}$, each may combine to form a ring. As examples of the ring formed by $R_{31}$ and $R_{32}$ are cited a piperidine ring, pyrrolidine ring, morpholine ring, pyrrole ring, piperazine ring or thiomorpholine ring, as examples of a ring formed by $R_{33}$ and $R_{34}$, and $R_{34}$ and $R_{35}$, respectively, are cited a benzene ring, thiophene, furan ring and pyrrole ring.

Examples of a compound represented by formula (B-I) are shown as below, but the present invention is not limited thereto.

B-1

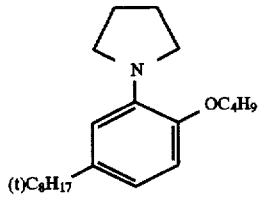

B-2

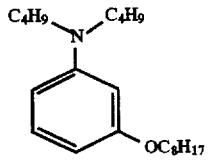

B-3

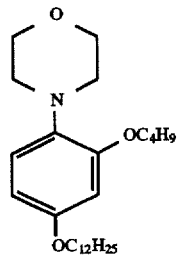

B-4

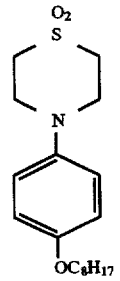

B-5

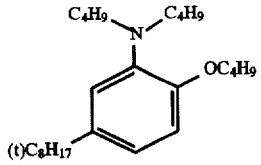

-continued

B-6

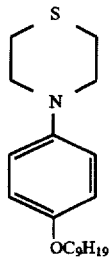

B-7

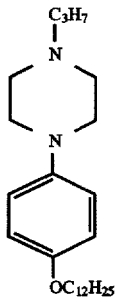

B-8

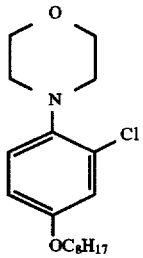

B-9

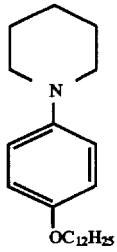

B-10

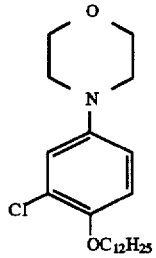

B-11

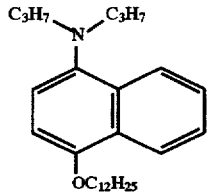

The compound represented by formula (B-I) is added in an amount of 1 to 500 mol %, preferably, 5 to 300 mol % of the coupler represented by formula (M-I). The compound may be added to a layer which is the same as or different from the layer in which the coupler is to be incorporated. The compound is preferably added to the same layer. The compound may be added simultaneously with the addition of the coupler or at a time different from that of the coupler.

The compound of formula (B-I) can be incorporated in a photographic material according to various dispersion methods known in the art, as employed in the case of the coupler of (M-I).

The compound of formula (B-I) can be dispersed by dissolving it in a solvent with the coupler, or by dissolving in another optimal solvent, separately from the coupler; it is preferable to disperse the compound by dissolving it, with the coupler, in the same solvent. The compound can be dispersed directly in a gelatin aqueous solution containing a surfactant by using a high-speed rotating mixer, simultaneously with or separately from the coupler and without the use of a solvent.

Silver halide grains contained in the photographic material of the present invention comprise preferably silver iodobromide, silver iodochloride or silver iodochlorobromide, more preferably, silver iodobromide or silver iodochlorobromide, each containing 2 to 25 mol % iodide.

The silver halide grains may be regular crystals such as cubic, octahedral or tetradecahedral ones, ones having an irregular form such as spherical or tabular form, ones having a crystal defect such as a twin plane, or composite thereof.

The silver halide grain size is not limitative, and may be monodispersed or polydispersed, preferably monodispersed.

The silver halide emulsion usable in the present invention can be prepared in accordance with methods as described in Research Disclosure No. 17643 (1978) pages 2–23 and ibid No. 18716 (1989) page 648; Glafkides, Chemicet Phisique Photographique, Paul Montel, 1967; and G. F. Duffin, Photographic Emulsion Chemistry, Focal Press, 1966.

Silver halide grains used in the present invention are preferably tabular grains having an average aspect ratio of not less than 2, more preferably not less than 3 and less than 20, and furthermore preferably not less than 5 and less than 10. The tabular grains preferably account for not less than 59% of the projected area of the total grains. The tabular grains can be prepared in a manner as described in U.S. Pat. Nos. 4,434,226, 4,414,310 and 4,439,520.

The silver halide emulsion used in the present invention can be prepared with reference to Research Disclosure (hereinafter, referred to as RD) 308119.

Relevant portions thereof are shown as follows.

| Item | Pages in RD 308119 |
|---|---|
| Iodide composition | 993 I-A |
| Preparation method | 993 I-A and 994 E |
| Crystal habit | |
| Regular crystal | 993 I-A |
| Twinned crystal | " |
| Epitaxial | " |
| Halide composition | |
| Uniform | 993 I-B |
| Nonuniform | " |
| Halide conversion | 994 I-C |
| Halide substitution | " |
| Metal doping | 994 I-D |
| Monodispersion | 995 I-F |
| Solvent addition | " |

-continued

| Item | Pages in RD 308119 |
|---|---|
| Latent image formation | |
| Surface | 995 I-G |
| Internal | " |
| Photographic material | |
| Negative | 995 I-H |
| Positive (including internally fogged grains) | " |
| Emulsion blend | 995 I-J |
| Desalting | 995 II-A |

In the present invention, a silver halide emulsion is subjected to physical ripening, chemical ripening and spectral sensitization. Additives used in these process are described in RD 17643, 18716 and 308119.

Relevant portions thereof are as follows.

| Item | Page in RD 308119 | RD 17643 | RD 18716 |
|---|---|---|---|
| Chemical sensitizer | 996 III-A | 23 | 648 |
| Super-sensitizer | 996 IV-A to E, J | 23–24 | 648–9 |
| Antifoggant | 998 VI | 24–25 | 649 |
| Stabilizer | 998 VI | 24–25 | 649 |

Well-known photographic additives usable in the invention are also described in the above Rds. Relevant portions are shown as follows.

| Item | Page in RD 308119 | RD 17643 | RD 18716 |
|---|---|---|---|
| Antistaining agent | 1002 VII-I | 25 | 650 |
| Dye image stabilizer | 1001 VII-J | 25 | |
| Brightener | 998 V | 24 | |
| UV absorbent | 1003 VIII-C XIII-C | 25–26 | |
| Light absorbing agent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 XVI | | |
| Developing agent (included in material) | 1011 XXB | | |

Various types of couplers can be used in the invention and examples thereof are described in the above Rds. Relevant portions thereof are shown as below.

| Item | Page in RD 308119 | RD 17643 | RD 18716 |
|---|---|---|---|
| Yellow coupler | 1001 VII-D | VIIC-G | |
| Cyan coupler | 1001 VII-D | VIIC-G | |
| Colored coupler | 1001 VII-G | VIIG | |
| DIR coupler | 1001 VII-F | VIIF | |
| BAR coupler | 1002 VII-F | | |
| Photographic-useful group releasing coupler | 1001 VII-F | | |
| Alkali-soluble coupler | 1001 VII-E | | |

The additives can be added in accordance with a dispersion method, for example, as described in RD 308119 XIV.

In the invention, there can be used a support, as described in RD 17643, page 28 and RD 18716, pages 647–8 and RD 308119, XIX.

In the photographic material of the invention, there is provided an auxiliary layer such as a filter layer or interlayer, as described in RD 308119 VII-K.

The photographic material of the invention may have a layer arrangement such as conventional layer order, reversed layer order or unit constitution.

The present invention can be applied to various types of color photographic light sensitive materials including a color negative film for general use or movie, a color reversal film for slide or television and a color positive film.

The photographic light sensitive material of the invention can be processed according to the conventional manner as described in RD 17643, pages 28–29; RD 18716, page 615; and RD 308119, XIX.

EXAMPLES

Examples of the present invention will be explained in detail, but the invention is not limited the embodiments.

Example 1

Preparation of Sample 101

A silver iodobromide emulsion which contain silver iodobromide grains having an average grain size of 0.4 μm and an average iodide content of 8 mol %, each grain comprising an internal core containing 15 mol % iodide, was optimally chemical-sensitized with gold and sulfur; thereafter, an exemplified sensitizing dye I-3 was added, in an amount of $7.5\times10^{-5}$ mol per mol of silver, to the emulsion to obtain a green-sensitive silver halide emulsion.

Subsequently, 4-hydroxy-6-methyl-1,3,3a,7-tetrazaindene and 1-phenyl-5-mercaptotetrazole were added to stabilize the emulsion.

Further, a comparative coupler MR-1 was dissolved in ethyl acetate and tricresyl phosphate (TCP) so as to be in an amount of 2.2 mols per mol of silver halide. The resulting solution was dispersed in an aqueous gelatin solution to obtain a emulsified dispersion. The dispersion and photographic additives such as a coating aid and hardener were added to the silver halide emulsion to prepare a coating solution, which was coated on a cellulose acetate support according to the conventional manner to obtain a photographic material sample 101.

Preparation of Samples 102 to 112

Samples 102 to 112 were prepared in the same manner as Sample 101, except that sensitizing dye I-3 or coupler MR-1 was replaced by an equimolar amount of a dye or coupler as shown in Table 1.

Comparative compound
Magenta coupler

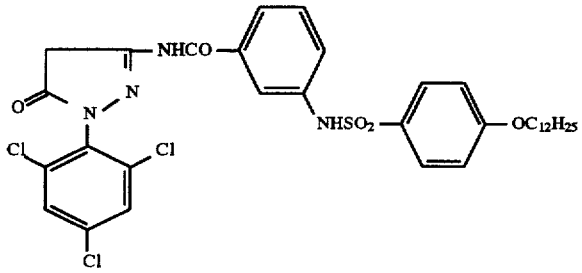

MR-1

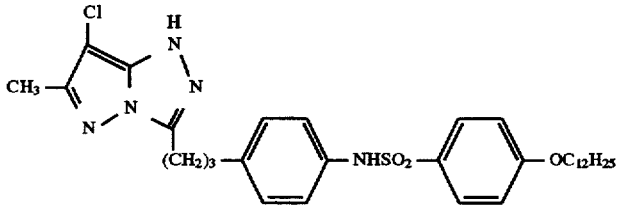

MR-2

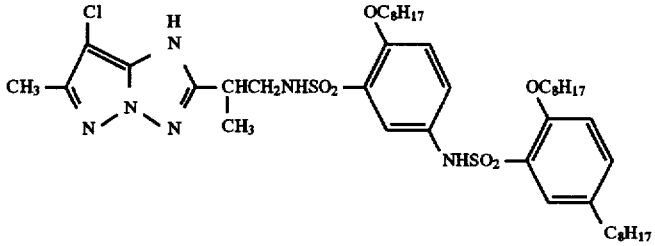

MR-3

Sensitizing dye

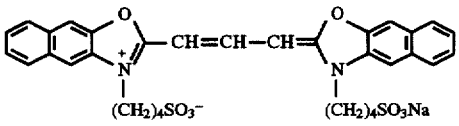

SR-1

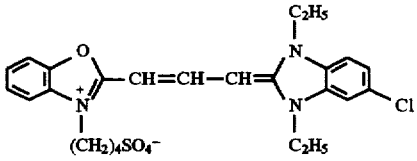

SR-2

Thus prepared samples were exposed through an optical wedge in the conventional manner and processed according to the following steps to be evaluated with respect to fog and sensitivity. The sensitivity was shown as a relative value, based on the sensitivity of Sample 102 being 100.

Processing steps:

| Steps | Time | Temperature |
|---|---|---|
| Color developing | 3 min. 15 sec. | 38.0 ± 0.1° C. |
| Bleaching | 6 min. 30 sec. | 38.0 ± 3.0° C. |
| Washing | 3 min. 15 sec. | 24 to 41° C. |
| Fixing | 6 min. 30 sec. | 38.0 ± 3.0° C. |
| Washing | 3 min. 15 sec. | 24 to 41° C. |
| Stabilizing | 3 min. 15 sec. | 38.0 ± 3.0° C. |
| Drying | | 50° C. or lower |

Compositions of processing solutions employed in each step were as follows.

Color developer

| | |
|---|---|
| 4-Amino-3-methyl-N-ethyl-N-(β hydroxyethyl)aniline sulfate | 4.75 g |
| Sodium sulfite anhydride | 4.25 g |
| Hydroxylamine 1/2 sulfate | 2.00 g |
| Potassium carbonate anhydride | 37.50 g |
| Sodium bromide | 1.30 g |
| Trisodium nitrilotriacetate monohydrate | 2.50 g |
| Potassium hydroxide | 1.00 g |

Water is added to make 1 liter and the pH is adjusted to 0.1.

Bleaching solution

| | |
|---|---|
| Iron (III) ethylenediaminetetra-acetate ammonium salt | 100.0 g |
| Diammonium ethylenediaminetetraacetate | 10.0 g |
| Ammonium bromide | 150.0 g |
| Glacial acetic acid | 10.0 ml |
| Water to make | 1 liter |

The pH is adjusted to 6.0.

Fixing solution

| | |
|---|---|
| Ammonium thiosulfate | 175.0 g |
| Sodium sulfite anhydride | 8.5 g |
| Sodium metasulfite | 2.3 g |
| Water to make | 1 liter |

Stabilizing solution

| | |
|---|---|
| Formalin (37% aqueous solution) | 1.5 ml |
| Koniducks (produced by Konica) | 7.5 ml |
| Water to make | 1 liter |

Photographic material samples were also evaluated with respect to their processing stability.

Thus, the difference in sensitivity between when developed at a standard temperature (38° C.) and when developed at a lower temperature by 1° C. (37° C.) was denoted as a relative value, as shown in Table 1. The less is the value, the better is the processing stability.

TABLE 1

| Sample No. | Coupler | Sensitizing dye | Fog | Sensitivity | Processing stability |
|---|---|---|---|---|---|
| 101 (Comp.) | MR-1 | I-3 | 0.10 | 100 | 22 |
| 102 (Comp.) | MR-2 | I-3 | 0.11 | 112 | 43 |
| 103 (Comp.) | MR-3 | I-3 | 0.09 | 107 | 39 |
| 104 (Inv.) | MR-27 | I-3 | 0.05 | 124 | 15 |
| 105 (Inv.) | M-1 | I-3 | 0.06 | 248 | 11 |
| 106 (Inv.) | M-3 | I-3 | 0.06 | 253 | 10 |
| 107 (Inv.) | M-5 | I-3 | 0.07 | 245 | 12 |
| 108 (Inv.) | M-8 | I-3 | 0.06 | 251 | 11 |
| 109 (Inv.) | M-15 | I-3 | 0.07 | 247 | 13 |
| 110 (Inv.) | M-18 | I-3 | 0.06 | 242 | 13 |
| 111 (Comp.) | M-27 | SR-1 | 0.08 | 108 | 29 |
| 112 (Comp.) | M-27 | SR-2 | 0.08 | 69 | 35 |

As can be seen from Table 1, inventive samples each were low in fog, high in sensitivity and superior in processing stability, as compared to comparative samples.

Example 2

Preparation of Silver halide emulsion

Silver halide emulsions A to F as shown in Table 2 were prepared, in which an emulsion containing octahedral silver iodobromide grains mainly comprising (111) face was prepared according to the manner described in JP-A 60-138538 and a tabular grain emulsion was prepared according to the manner described in JP-A 3-94248.

TABLE 2

| Emulsion | Av. grain size (μm) | Grain form | Av. aspect ratio | Av. iodide content (mol %) |
|---|---|---|---|---|
| A | 0.30 | Octahedral | 1.0 | 4.0 |
| B | 0.42 | Octahedral | 1.0 | 6.0 |
| C | 0.55 | Tabular | 2.0 | 6.0 |
| D | 0.85 | Tabular | 2.2 | 6.0 |
| E | 0.95 | Tabular | 2.0 | 6.0 |
| F | 0.85 | Tabular | 5.2 | 6.0 |

Preparation of Color photographic material

On a triacetylcellulose support, layers having the following compositions were coated in this order to prepare multi-layered color photographic light sensitive materials, Samples 201 to 210.

Composition of the layers

The coating amounts of silver halide or colloidal silver was expressed as an equivalent silver amount in terms of $g/m^2$. The amount of a coupler, additive or gelatin was expressed as an addition amount in $g/m^2$, and that of a sensitizing dye is expressed in mol per mol of silver halide contained in the same layer.

1st layer: Antihalation layer

| | |
|---|---|
| Black colloidal silver | 0.16 |
| UV absorbent (UV-1) | 0.20 |
| High boiling solvent (OIL-1) | 0.16 |
| gelatin | 1.60 |

2nd layer: interlayer

| | |
|---|---|
| Compound (SC-1) | 0.14 |
| High boiling solvent (OIL-4) | 0.17 |
| Gelatin | 0.80 |

3rd layer: Low-speed red-sensitive layer

| | |
|---|---|
| Silver iodobromide emulsion A | 0.15 |
| Silver iodobromide emulsion B | 0.35 |
| Sensitizing dye (SD-1) | $2.0 \times 10^{-4}$ |
| Sensitizing dye (SD-2) | $1.4 \times 10^{-4}$ |
| Sensitizing dye (SD-3) | $1.4 \times 10^{-5}$ |
| Sensitizing dye (SD-4) | $0.7 \times 10^{-4}$ |
| Cyan coupler (C-2) | 0.53 |
| Colored cyan coupler (CC-1) | 0.04 |
| DIR compound (D-1) | 0.025 |
| High boiling solvent (OIL-3) | 0.48 |
| Gelatin | 1.09 |

4th layer: Medium-speed red-sensitive layer

| | |
|---|---|
| Silver iodobromide emulsion B | 0.30 |
| Silver iodobromide emulsion C | 0.34 |
| Sensitizing dye (SD-1) | $1.7 \times 10^{-4}$ |
| Sensitizing dye (SD-2) | $0.86 \times 10^{-4}$ |
| Sensitizing dye (SD-3) | $1.15 \times 10^{-5}$ |
| Sensitizing dye (SD-4) | $0.86 \times 10^{-4}$ |
| Cyan coupler (C-2) | 0.33 |
| Colored cyan coupler (CC-1) | 0.013 |
| DIR compound (D-1) | 0.02 |
| High boiling solvent (OIL-1) | 0.16 |
| Gelatin | 0.79 |

5th layer: High-speed red-sensitive layer

| | |
|---|---|
| Silver iodobromide emulsion D | 0.95 |
| Sensitizing dye (SD-1) | $1.0 \times 10^{-4}$ |
| Sensitizing dye (SD-2) | $1.0 \times 10^{-4}$ |
| Sensitizing dye (SD-3) | $1.2 \times 10^{-5}$ |
| Cyan coupler (C-2) | 0.14 |
| Colored cyan coupler (CC-1) | 0.016 |
| High boiling solvent (OIL-1) | 0.16 |
| Gelatin | 0.79 |

6th layer: Interlayer

| | |
|---|---|
| Compound (SC–) | 0.09 |
| High boiling solvent (OIL-4) | 0.11 |
| Gelatin | 0.80 |

7th layer: Low-speed green-sensitive layer

| | |
|---|---|
| Silver iodobromide emulsion A | 0.12 |
| Silver iodobromide emulsion B | 0.38 |
| Sensitizing dye (SD-4) | $4.6 \times 10^{-5}$ |
| Sensitizing dye (SD-5) | $4.1 \times 10^{-4}$ |
| Magenta coupler (M-2) | 0.14 |
| Magenta coupler (M-3) | 0.14 |

-continued

| | |
|---|---|
| Colored magenta coupler (CM-1) | 0.03 |
| Colored magenta coupler (CM-2) | 0.03 |
| High boiling solvent (OIL-2) | 0.34 |
| Gelatin | 0.70 |

8th layer: Interlayer

| | |
|---|---|
| Gelatin | 0.41 |

9th layer: Medium-speed green-sensitive layer

| | |
|---|---|
| Silver iodobromide emulsion B | 0.30 |
| Silver iodobromide emulsion C | 0.34 |
| Sensitizing dye (SD-6) | $1.2 \times 10^{-4}$ |
| Sensitizing dye (SD-7) | $1.2 \times 10^{-4}$ |
| Sensitizing dye (SD-8) | $1.2 \times 10^{-4}$ |
| Magenta coupler (M-2) | 0.04 |
| Magenta coupler (M-3) | 0.04 |
| Colored magenta coupler (CM-1) | 0.008 |
| Colored magenta coupler (CM-2) | 0.009 |
| DIR compound (D-2) | 0.025 |
| DIR compound (D-3) | 0.002 |
| High boiling solvent (OIL-2) | 0.12 |
| Gelatin | 0.50 |

10th layer: High-speed green-sensitive layer

| | |
|---|---|
| Silver iodobromide emulsion (Table 3) | 0.95 |
| Sensitizing dye (SD-8) | $12.2 \times 10^{-5}$ |
| Sensitizing dye (Table 3) | $9.1 \times 10^{-5}$ |
| Magenta coupler (Table 3) | 0.09 |
| Colored magenta coupler (CM-1) | 0.005 |
| Colored magenta coupler (CM-2) | 0.006 |
| Compound of formula (B-1) (Table 3) | 0.027 |
| High boiling solvent (OIL-2) | 0.11 |
| Gelatin | 0.79 |

11th layer: Yellow filter layer

| | |
|---|---|
| Yellow colloidal silver | 0.08 |
| Compound (SC-1) | 0.15 |
| High boiling solvent (OIL-4) | 0.19 |
| Gelatin | 1.10 |

12th layer: Low-speed blue-sensitive layer

| | |
|---|---|
| Silver iodobromide emulsion A | 0.12 |
| Silver iodobromide emulsion B | 0.24 |
| Silver iodobromide emulsion C | 0.12 |
| Sensitizing dye (SD-9) | $6.3 \times 10^{-5}$ |
| Sensitizing dye (SD-10) | $1.0 \times 10^{-5}$ |
| Yellow coupler (Y-1) | 0.50 |
| Yellow coupler (Y-2) | 0.50 |
| DIR compound (D-4) | 0.04 |
| DIR compound (D-5) | 0.02 |
| High boiling solvent (OIL-4) | 0.42 |
| Gelatin | 1.40 |

13th layer: High-speed blue-sensitive layer

| | |
|---|---|
| Silver iodobromide emulsion C | 0.15 |
| Silver iodobromide emulsion E | 0.80 |
| Sensitizing dye (SD-9) | $8.0 \times 10^{-5}$ |
| Sensitizing dye (SD-11) | $3.1 \times 10^{-5}$ |
| Yellow coupler (Y-1) | 0.12 |
| High boiling solvent (OIL-4) | 0.05 |
| Gelatin | 0.79 |

14th layer: First protective layer

| | |
|---|---|
| Silver iodobromide emulsion (av. grain size; 0.08 μm, iodide; 1.0 mol %) | 0.40 |
| UV absorbent (UV-1) | 0.065 |
| High boiling solvent (OIL-1) | 0.07 |
| High boiling solvent (OIL-3) | 0.07 |
| Gelatin | 0.65 |

15th layer: Second protective layer

| | |
|---|---|
| Alkali-soluble matting agent PM-1 (av. particle size 2 μm) | 0.15 |
| Polymethyl methacrylate (av. size 3 μm) | 0.04 |
| Sliding agent (WAX-1) | 0.04 |
| Gelatin | 0.55 |

In addition to the above composition, there were incorporated coating aids (SU-1 and 2), a viscosity adjusting agent, hardeners (H-1 and 2), a stabilizer (ST-1), antifoggants (AF-1, 2 and 3), antifoggant (AF-4, a mixture of average molecular weights 10,000 and 1,100,000 and an antiseptic (DI-1).

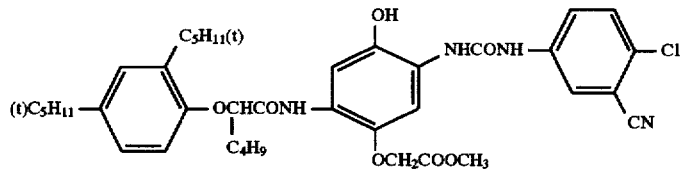

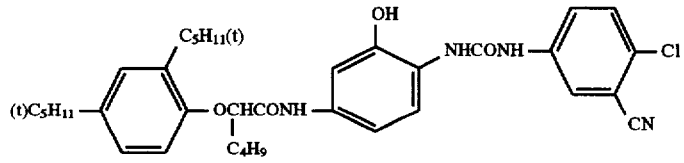

-continued
M-2
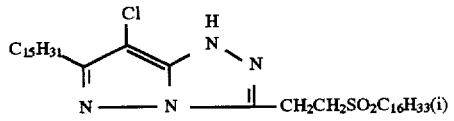
M-3
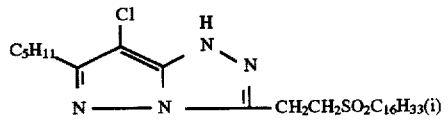
Y-1
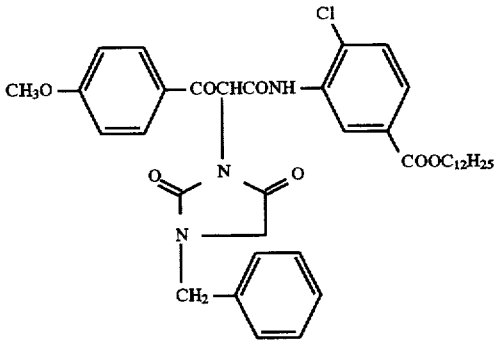
Y-2
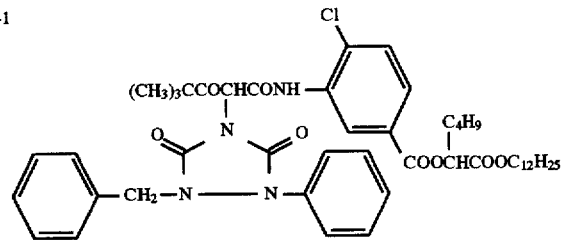
CC-1
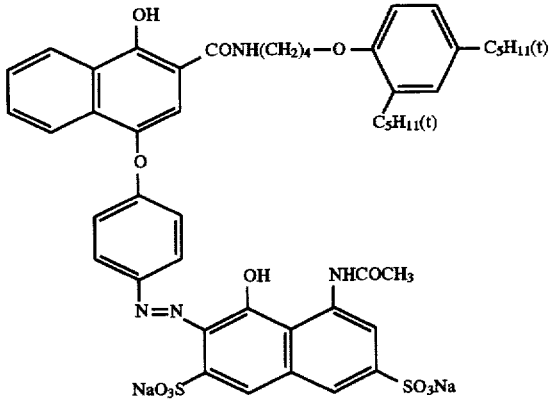
CM-1
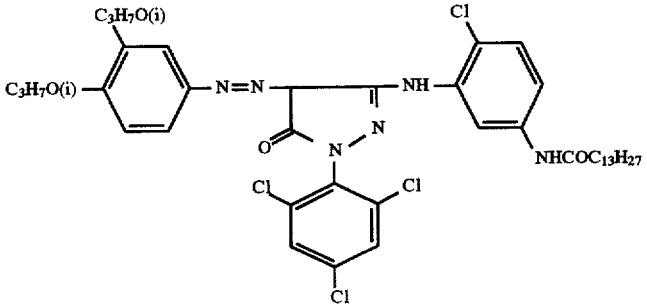
CM-2
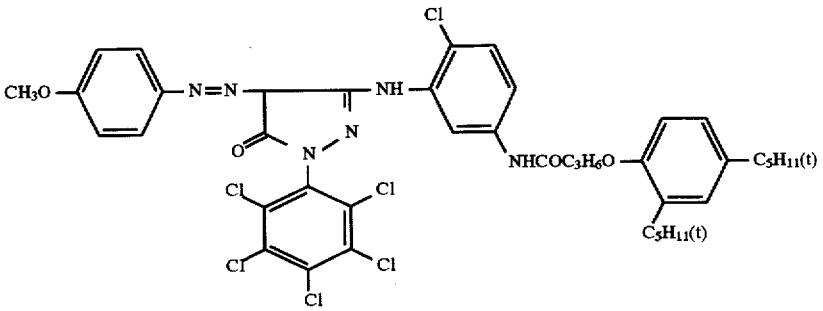

-continued
D-1
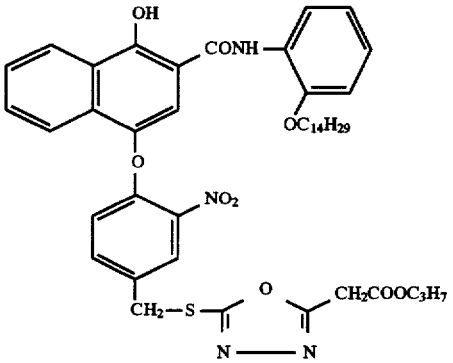
D-2
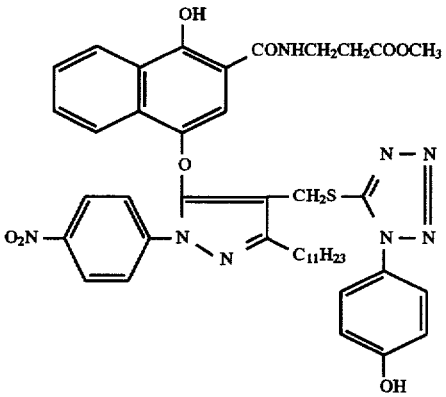
D-3
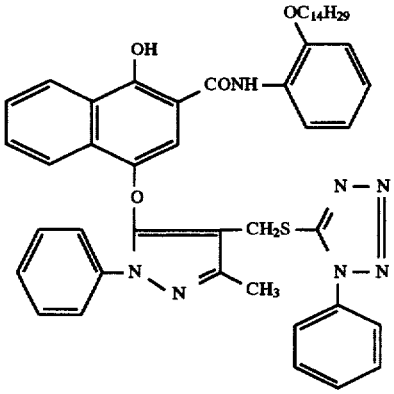
D-4
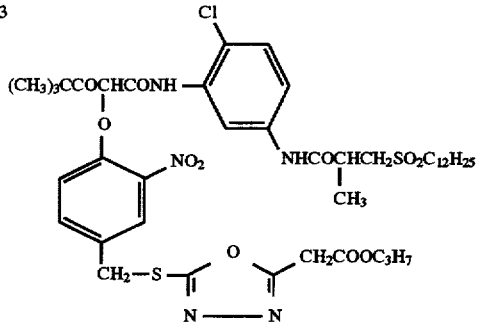
D-5
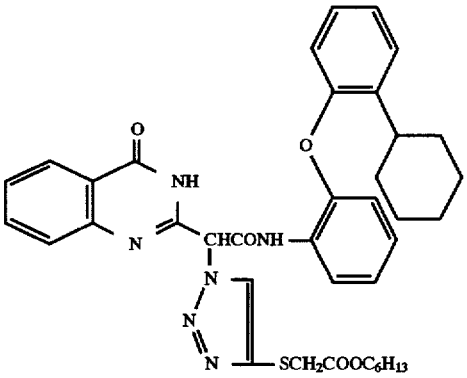
OIL-1
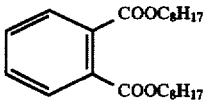
OIL-2
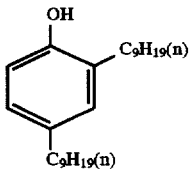
OIL-3
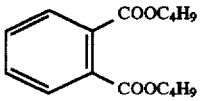
OIL-4
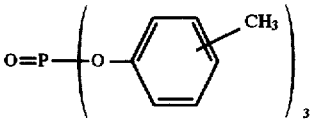
SC-1
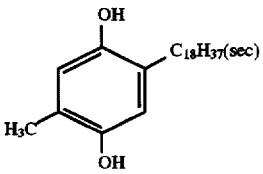

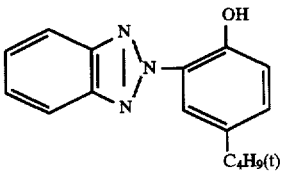
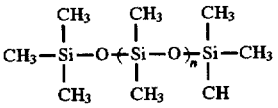
Weight average molecular weight, Mw = 3,000
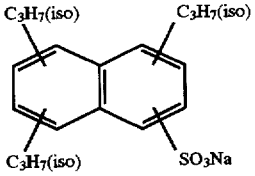
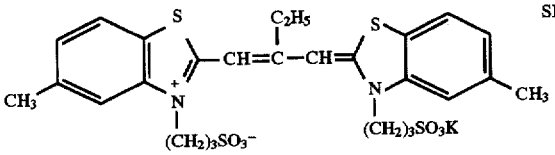
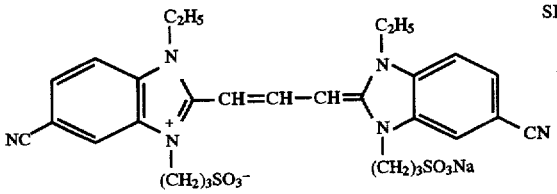
-continued
UV-1
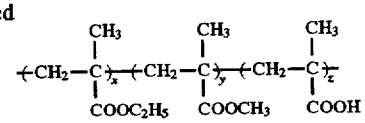
WAX-1
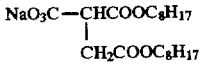
Su-2
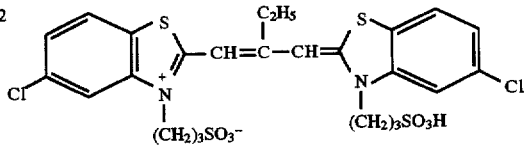
SD-2
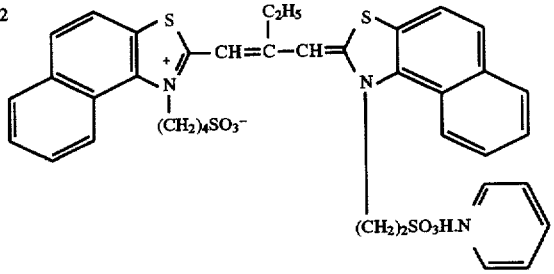
SD-4
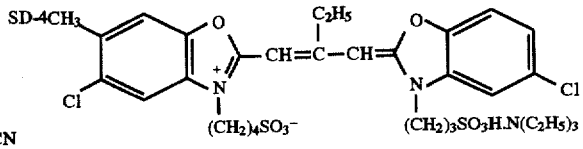
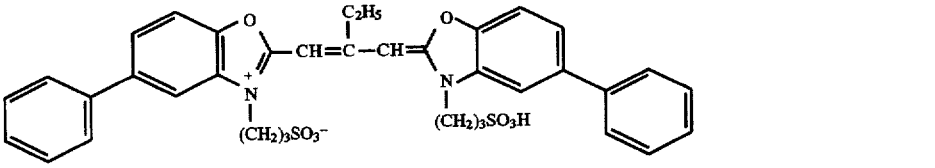
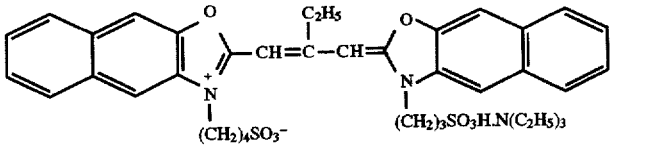
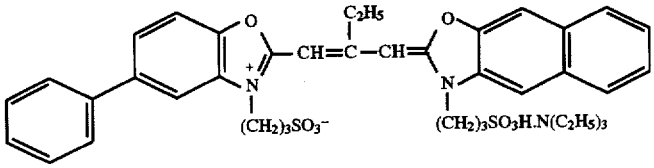
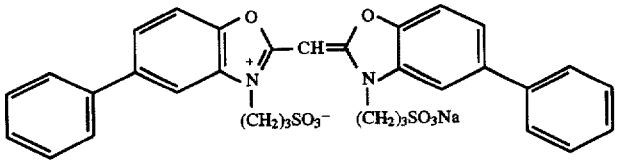
PM-1
Su-1
SD-1
SD-3
SD-5
SD-6
SD-7
SD-8
SD-9

-continued

SD-10

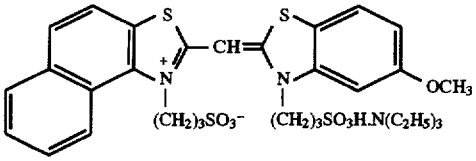

SD-11

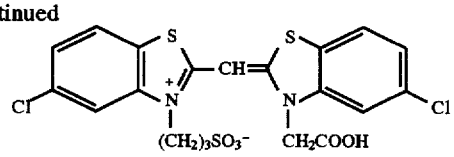

H-1

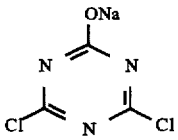

H-2

$(CH_2{=}CHSO_2CH_2)_2O$

ST-1

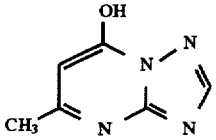

AF-1

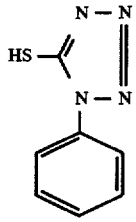

AF-2

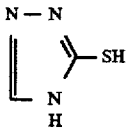

AF-3

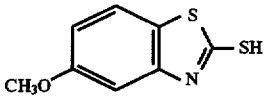

AF-4

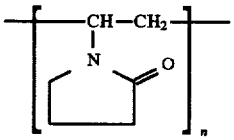

n: Polymerization degree

DI-1 (Mixture)

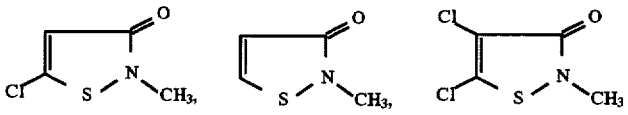

A B C

A:B:C = 50:46:4

Samples each were subjected to exposure and processing and evaluated with respect to fog, sensitivity and processing stability in the same manner as in Example 1. The sensitivity is denoted as a relative value, based on the sensitivity of Sample 201 being 100. Results thereof are shown in table 3.

TABLE 3

| Sample No. | Coupler | Sensitizing dye | Compound | Emulsion | Fog | Sensitivity | Processing stability |
|---|---|---|---|---|---|---|---|
| 201(C) | MR-1 | I-19 | — | D | 0.11 | 100 | 22 |
| 202(C) | MR-2 | I-19 | — | D | 0.10 | 114 | 34 |
| 203(C) | MR-3 | I-19 | — | D | 0.11 | 109 | 30 |
| 204(I) | MR-17 | I-19 | — | D | 0.06 | 256 | 12 |
| 205(I) | MR-17 | I-23 | — | D | 0.05 | 277 | 9 |
| 206(I) | MR-3 | I-23 | — | D | 0.07 | 281 | 7 |
| 207(I) | MR-3 | I-23 | B-2 | D | 0.02 | 288 | 5 |
| 208(I) | MR-3 | I-23 | B-5 | D | 0.03 | 285 | 5 |
| 209(I) | MR-3 | I-23 | B-5 | F | 0.02 | 303 | 4 |
| 210(I) | MR-3 | I-19 | B-5 | F | 0.03 | 307 | 5 |

C: Comparative
I: Inventive

As can be seen from Table 3, a combination of inventive couple and sensitizing dye led to low fog, high sensitivity and excellent processing stability, from comparison of Sample 206 with Samples 207 to 210, it is shown that the use of a compound represented by formula (B-1) resulted in further lowered fog.

Example 3

Silver halide color photographic material samples 301 and 318 were prepared in a similar manner to Example 2, provided that the following layers were varied as shown below.

5th layer: High-speed red-sensitive layer

| | |
|---|---|
| Silver iodobromide emulsion D | 0.95 |
| Sensitizing dye (SD-1) | $1.0 \times 10^{-4}$ |
| Sensitizing dye (SD-2) | $1.0 \times 10^{-4}$ |
| Sensitizing dye (SD-3) | $1.2 \times 10^{-4}$ |
| Cyan coupler (as shown in Table 4) | 0.14 |
| Colored cyan coupler | 0.016 |
| High boiling solvent (OIL-1) | 0.16 |
| Gelatin | 0.79 |

7th layer: Low-speed green-sensitive layer

| | |
|---|---|
| Silver iodobromide emulsion A | 0.12 |
| Silver iodobromide emulsion B | 0.38 |
| Sensitizing dye (as shown in Table 4) | $5.0 \times 10^{-4}$ |
| Magenta coupler (M-2) | 0.14 |
| Magenta coupler (M-3) | 0.14 |
| Colored magenta coupler (CM-1) | 0.03 |
| Colored magenta coupler (CM-2) | 0.03 |
| High boiling solvent (OIL-2) | 0.34 |
| Gelatin | 0.70 |

9th layer: Medium-speed green-sensitive layer

| | |
|---|---|
| Silver iodobromide emulsion B | 0.30 |
| Silver iodobromide emulsion B | 0.34 |
| Sensitizing dye (as shown in Table 4) | $3.6 \times 10^{-4}$ |
| Magenta coupler (M-2) | 0.04 |
| Magenta coupler (M-3) | 0.04 |
| Colored magenta coupler (CM-1) | 0.008 |
| Colored magenta coupler (CM-2) | 0.009 |
| DIR compound (D-2) | 0.025 |
| DIR compound (D-3) | 0.002 |
| High boiling solvent (OIL-2) | 0.12 |
| Gelatin | 0.50 |

10th layer: High-speed green-sensitive layer

| | |
|---|---|
| Silver iodobromide emulsion D | 0.95 |
| Sensitizing dye (as shown in Table 4) | $2.1 \times 10^{-4}$ |
| Magenta coupler (M-3)) | 0.09 |
| Colored magenta coupler (CM-1) | 0.005 |
| Colored magenta coupler (CM-2) | 0.006 |
| High boiling solvent (OIL-2) | 0.11 |
| Gelatin | 0.79 |

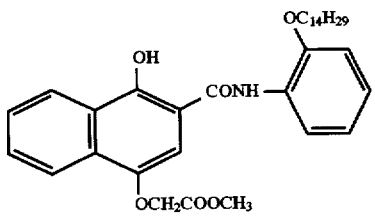

CR-1

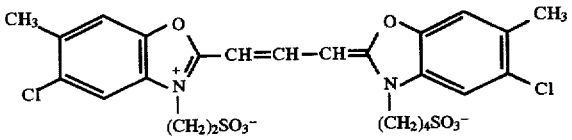

SR-3

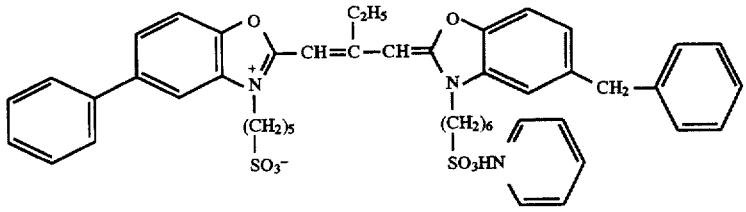

SR-4

Samples were allowed to stand for (a) 35 days in a refrigerator or (b) 35 days at 25° C. and 90% R.H. Thereafter, samples aged were exposed and processed in a similar manner to Example 2, and evaluated with respect to variations in sensitivity of samples aged in (b) against to those aged in (a). The smaller is the vale, the storage stability is the better. Results thereof are summarized in Table 4.

TABLE 4

| Sample No. | Coupler | Sensitizing dye | Storage stability |
|---|---|---|---|
| 301 (Comp.) | CR-1 | I-12 | 20 |
| 302 (Comp.) | CR-4 | SR-3 | 49 |
| 303 (Comp.) | CII-3 | SR-3 | 51 |
| 304 (Comp.) | CI-4 | SR-4 | 53 |
| 305 (Comp.) | CII-3 | SR-4 | 48 |
| 306 (Inv.) | CI-1 | I-12 | 9 |
| 307 (Inv.) | CI-4 | I-12 | 14 |
| 308 (Inv.) | CII-1 | I-12 | 11 |
| 309 (Inv.) | CII-3 | I-12 | 16 |
| 310 (Inv.) | CII-9 | I-12 | 10 |
| 311 (Inv.) | CII-17 | I-12 | 11 |
| 312 (Inv.) | CII-12 | I-12 | 17 |
| 313 (Inv.) | CI-1 | I-7 | 8 |
| 314 (Inv.) | CI-1 | I-15 | 10 |
| 315 (Inv.) | CI-1 | I-39 | 11 |
| 316 (Inv.) | CI-1 | I-42 | 10 |
| 317 (Inv.) | CII-9 | I-7 | 9 |
| 318 (Inv.) | CII-9 | I-42 | 9 |

As can be seen from the Table, the inventive samples were shown to be excellent in storage stability at a high humidity.

Example 4

A silver iodobromide emulsion, which was comprised of silver iodobromide grains having an average size of 0.4 μm and average iodide content of 8 mol % with internal core having an iodide content of 15 mol %, was optimally chemical-sensitized with sulfur and gold and thereto was added a sensitizing dye, II-3 of $7.5 \times 10^{-5}$ mol per mol of silver. Thereafter, 4-hydroxy-6-methyl-1,3,3a,7-tetrazaindene and 1-phenyl-5-mercaptotetrazole were added to stabilize the emulsion.

Further, a cyan coupler, CR-1 was dissolved in ethyl acetate and tricresyl phosphate in an amount of 2.0 mol per mol of silver halide and dispersed in a gelatin aqueous solution. The resulting dispersion and further additives such as a coating aid and hardener were added to the emulsion to prepare a coating solution. The coating solution was coated on a subbed cellulose acetate support according to the conventional manner and dried to obtain sample 401.

Samples 402 to 410 were prepared in the same manner as sample 401, except that sensitizing dye II-3 and coupler CR-1 were replaced by an equimolar amount of a sensitizing dye or coupler as shown in Table 5.

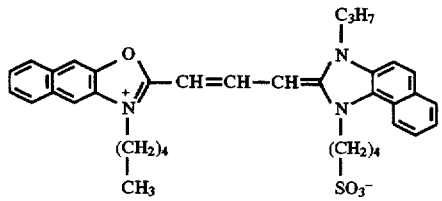

SR-5

Samples each were evaluated with respect to storage stability in the same manner as in Example 3. Results thereof are shown in Table 5.

TABLE 5

| Sample No. | Coupler | Sensitizing dye | Storage stability |
|---|---|---|---|
| 401 (Comp.) | CR-1 | II-3 | 31 |
| 402 (Comp.) | CI-4 | SR-5 | 51 |
| 403 (Comp.) | CII-3 | SR-5 | 53 |
| 404 (Inv.) | CI-1 | II-3 | 11 |
| 405 (Inv.) | CI-4 | II-3 | 16 |
| 406 (Inv.) | CII-1 | II-3 | 10 |
| 407 (Inv.) | CII-3 | II-3 | 14 |
| 408 (Inv.) | CII-9 | II-3 | 15 |
| 409 (Inv.) | CII-17 | II-3 | 12 |
| 410 (Inv.) | CII-23 | II-3 | 19 |

As can be seen from the Table, a combined use of inventive coupler and sensitizing dye achieved excellent storage stability at a high humidity.

Example 5

Silver halide photographic material samples 501 to 511 were prepared in a similar manner to Example 3, provided that the following layers were varied as shown below.

3rd layer: Low-speed red-sensitive layer

| | |
|---|---|
| Silver iodobromide emulsion A | 0.15 |
| Silver iodobromide emulsion B | 0.35 |
| Sensitizing dye (SD-1) | $2.0 \times 10^{-4}$ |
| Sensitizing dye (SD-12) | $1.4 \times 10^{-4}$ |
| Sensitizing dye (SD-3) | $1.4 \times 10^{-5}$ |
| Sensitizing dye (SD-4) | $0.7 \times 10^{-4}$ |
| Cyan coupler (C-2) | 0.53 |
| Colored cyan coupler (CC-1) | 0.04 |
| DIR compound (D-1) | 0.025 |
| High boiling solvent (OIL-3) | 0.48 |
| Gelatin | 1.09 |

4th layer: Medium-speed red-sensitive layer

| | |
|---|---|
| Silver iodobromide emulsion B | 0.30 |
| Silver iodobromide emulsion C | 0.34 |
| Sensitizing dye (SD-1) | $1.7 \times 10^{-4}$ |
| Sensitizing dye (SD-12) | $0.86 \times 10^{-4}$ |
| Sensitizing dye (SD-3) | $1.15 \times 10^{-5}$ |
| Sensitizing dye (SD-4) | $0.86 \times 10^{-4}$ |
| Cyan coupler (C-2) | 0.33 |
| Colored cyan coupler (CC-1) | 0.013 |
| DIR compound (D-1) | 0.02 |
| High boiling solvent (OIL-1) | 0.16 |
| Gelatin | 0.79 |

5th layer: High-speed red-sensitive layer

| | |
|---|---|
| Silver iodobromide emulsion D | 0.95 |
| Sensitizing dye (SD-1) | $1.0 \times 10^{-4}$ |
| Sensitizing dye (SD-12) | $1.0 \times 10^{-4}$ |
| Sensitizing dye (SD-3) | $1.2 \times 10^{-5}$ |
| Cyan coupler (as shown in Table 6) | 0.14 |
| Colored cyan coupler (CC-1) | 0.016 |
| High boiling solvent (OIL-1) | 0.16 |
| Gelatin | 0.79 |

7th layer: Low-speed green-sensitive layer

| | |
|---|---|
| Silver iodobromide emulsion A | 0.12 |
| Silver iodobromide emulsion B | 0.38 |
| Sensitizing dye (as shown in Table 6) | $5.0 \times 10^{-4}$ |
| Magenta coupler (M-2) | 0.14 |
| Magenta coupler (M-3) | 0.14 |
| Colored magenta coupler (CM-1) | 0.03 |
| Colored magenta coupler (CM-2) | 0.03 |
| High boiling solvent (OIL-2) | 0.34 |
| Gelatin | 0.70 |

9th layer: Medium-speed green-sensitive layer

| | |
|---|---|
| Silver iodobromide emulsion B | 0.30 |
| Silver iodobromide emulsion C | 0.34 |
| Sensitizing dye (as shown in Table 6) | $3.6 \times 10^{-4}$ |
| Magenta coupler (M-2) | 0.04 |
| Magenta coupler (M-3) | 0.04 |
| Colored magenta coupler (CM-1) | 0.008 |
| Colored magenta coupler (CM-2) | 0.009 |
| DIR compound (D-2) | 0.025 |
| DIR compound (D-3) | 0.002 |
| High boiling solvent (OIL-2) | 0.12 |
| Gelatin | 0.50 |

10th layer: High-speed green-sensitive layer

| | |
|---|---|
| Silver iodobromide emulsion D | 0.95 |
| Sensitizing dye (as shown in Table 6) | $2.1 \times 10^{-4}$ |
| Magenta coupler (M-3) | 0.09 |
| Colored magenta coupler (CM-1) | 0.005 |
| Colored magenta coupler (CM-2) | 0.006 |
| High boiling solvent (OIL-2) | 0.11 |
| Gelatin | 0.79 |

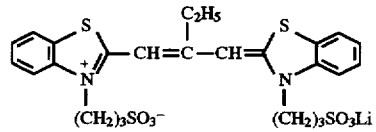

SD-12

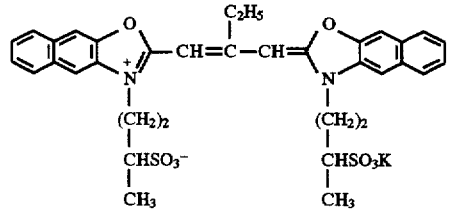

SR-6

Samples each ere evaluated with respect to the storage stability in the same manner as in Example 3. Results thereof are shown in Table 6.

TABLE 6

| Sample No. | Coupler | Sensitizing dye | Storage stability |
|---|---|---|---|
| 501 (Comp.) | CR-1 | II-19 | 19 |
| 502 (Comp.) | CI-1 | SR-6 | 36 |
| 503 (Comp.) | CII-17 | SR-6 | 34 |
| 504 (Inv.) | CI-1 | II-11 | 6 |
| 505 (Inv.) | CI-1 | II-19 | 8 |
| 506 (Inv.) | CI-1 | II-23 | 6 |
| 507 (Inv.) | CI-1 | II-37 | 7 |
| 508 (Inv.) | CII-17 | II-11 | 6 |
| 509 (Inv.) | CII-17 | II-19 | 7 |
| 510 (Inv.) | CII-17 | II-23 | 6 |
| 511 (Inv.) | CII-17 | II-37 | 9 |

As can be seen from the Table, a combined use of inventive coupler and sensitizing dye achieved excellent storage stability at a high humidity.

Example 6

A silver iodobromide emulsion, which was comprised of silver iodobromide grains having an average size of 0.4 μm and average iodide content of 8 mol % with internal core having an iodide content of 15 mol %, was optimally chemical-sensitized with sulfur and gold and thereto was added a sensitizing dye, III-23 of $7.5\times10^{-5}$ mol per mol of silver. Thereafter, 4-hydroxy-6-methyl-1,3,3a,7-tetrazaindene and 1-phenyl-5-mercaptotetrazole were added to stabilize the emulsion.

Further, a cyan coupler, CR-1 was dissolved in ethyl acetate and dioctyl phthalate in an amount of 1.8 mol per mol of silver halide and dispersed in a gelatin aqueous solution. The resulting dispersion and further additives such as a coating aid and hardener were added to the emulsion to prepare a coating solution. The coating solution was coated on a subbed cellulose acetate support according to the conventional manner and dried to obtain sample 601.

Samples 602 to 615 were prepared in the same manner as sample 601, except that sensitizing dye III-23 and coupler CR-1 were replaced by an equimolar amount of a sensitizing dye or coupler as shown in Table 6.

SR-7

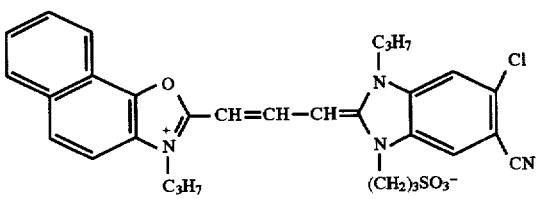

Samples each were evaluated with respect to storage stability in the same manner as in Example 3. Results thereof are shown in Table 5.

TABLE 7

| Sample No. | Coupler | Sensitizing dye | Storage stability |
|---|---|---|---|
| 601 (Comp.) | CR-1 | III-23 | 27 |
| 602 (Comp.) | CI-4 | SR-7 | 52 |
| 603 (Comp.) | CII-3 | SR-7 | 48 |
| 604 (Inv.) | CI-1 | III-23 | 12 |
| 605 (Inv.) | CI-4 | III-23 | 17 |
| 606 (Inv.) | CII-1 | III-23 | 11 |
| 607 (Inv.) | CII-3 | III-23 | 15 |
| 608 (Inv.) | CII-9 | III-23 | 13 |

TABLE 7-continued

| Sample No. | Coupler | Sensitizing dye | Storage stability |
|---|---|---|---|
| 609 (Inv.) | CII-17 | III-23 | 10 |
| 610 (Inv.) | CII-23 | III-23 | 21 |
| 611 (Inv.) | CI-1 | III-25 | 10 |
| 612 (Inv.) | CI-1 | III-29 | 10 |
| 613 (Inv.) | CI-1 | III-31 | 12 |
| 614 (Inv.) | CII-9 | III-25 | 11 |
| 615 (Inv.) | CII-9 | III-31 | 11 |

As can be seen from the Table, a combined use of inventive coupler and sensitizing dye achieved excellent storage stability at a high humidity.

Example 7

Silver halide photographic material samples 701 to 711 were prepared in a similar manner to Example 3, provided that the following layers were varied as shown below.

3rd layer: Low-speed red-sensitive layer

| | |
|---|---|
| Silver iodobromide emulsion A | 0.15 |
| Silver iodobromide emulsion B | 0.35 |
| Sensitizing dye (SD-1) | $2.0\times10^{-4}$ |
| Sensitizing dye (SD-13) | $1.4\times10^{-4}$ |
| Sensitizing dye (SD-3) | $1.4\times10^{-5}$ |
| Sensitizing dye (SD-4) | $0.7\times10^{-4}$ |
| Cyan coupler (C-2) | 0.53 |
| Colored cyan coupler (CC-1) | 0.04 |
| DIR compound (D-1) | 0.025 |
| High boiling solvent (OIL-3) | 0.48 |
| Gelatin | 1.09 |

4th layer: Medium-speed red-sensitive layer

| | |
|---|---|
| Silver iodobromide emulsion B | 0.30 |
| Silver iodobromide emulsion C | 0.34 |
| Sensitizing dye (SD-1) | $1.7\times10^{-4}$ |
| Sensitizing dye (SD-13) | $0.86\times10^{-4}$ |
| Sensitizing dye (SD-3) | $1.15\times10^{-5}$ |
| Sensitizing dye (SD-4) | $0.86\times10^{-4}$ |
| Cyan coupler (C-2) | 0.33 |
| Colored cyan coupler (CC-1) | 0.013 |
| DIR compound (D-1) | 0.02 |
| High boiling solvent (OIL-1) | 0.16 |
| Gelatin | 0.79 |

5th layer: High-speed red-sensitive layer

| | |
|---|---|
| Silver iodobromide emulsion D | 0.95 |
| Sensitizing dye (SD-1) | $1.0\times10^{-4}$ |
| Sensitizing dye (SD-13) | $1.0\times10^{-4}$ |
| Sensitizing dye (SD-3) | $1.2\times10^{-5}$ |
| Cyan coupler (as shown in Table 8) | 0.14 |
| Colored cyan coupler (CC-1) | 0.016 |
| High boiling solvent (OIL-1) | 0.16 |
| Gelatin | 0.79 |

7th layer: Low-speed green-sensitive layer

| | |
|---|---|
| Silver iodobromide emulsion A | 0.12 |
| Silver iodobromide emulsion B | 0.38 |
| Sensitizing dye (as shown in Table 8) | $5.0\times10^{-4}$ |
| Magenta coupler (M-2) | 0.14 |
| Magenta coupler (M-3) | 0.14 |
| Colored magenta coupler (CM-1) | 0.03 |

-continued

| | |
|---|---|
| Colored magenta coupler (CM-2) | 0.03 |
| High boiling solvent (OIL-2) | 0.34 |
| Gelatin | 0.70 |

9th layer: Medium-speed green-sensitive layer

| | |
|---|---|
| Silver iodobromide emulsion B | 0.30 |
| Silver iodobromide emulsion C | 0.34 |
| Sensitizing dye (as shown in Table 8) | $3.6 \times 10^{-4}$ |
| Magenta coupler (M-2) | 0.04 |
| Magenta coupler (M-3) | 0.04 |
| Colored magenta coupler (CM-1) | 0.008 |
| Colored magenta coupler (CM-2) | 0.009 |
| DIR compound (D-2) | 0.025 |
| DIR compound (D-3) | 0.002 |
| High boiling solvent (OIL-2) | 0.12 |
| Gelatin | 0.50 |

10th layer: High-speed green-sensitive layer

| | |
|---|---|
| Silver iodobromide emulsion D | 0.95 |
| Sensitizing dye (as shown in Table 8) | $2.1 \times 10^{-4}$ |
| Magenta coupler (M-3) | 0.09 |
| Colored magenta coupler (CM-1) | 0.005 |
| Colored magenta coupler (CM-2) | 0.006 |
| High boiling solvent (OIL-2) | 0.11 |
| Gelatin | 0.79 |

SD-13

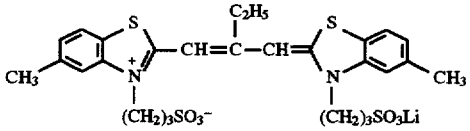

SR-8

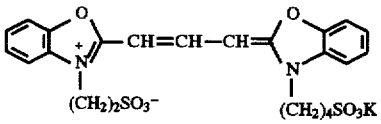

Samples 712 to 714 were prepared in the same manner as sample 704, except that sensitizing dye III-1 was replaced by an equimolar amount of 1:1 dye mixture as in Table 8.

Samples 715 to 717 were prepared in the same manner as sample 708, except that sensitizing dye III-1 was replaced by an equimolar amount of 1:1 dye mixture as in Table 8.

Samples 718 were prepared in the same manner as sample 704, except that sensitizing dye III-1 was replaced by an equimolar amount of 4:1:1 dye mixture as in Table 8.

Samples 719 and 720 were prepared in the same manner as sample 708, except that sensitizing dye III-1 was replaced by an equimolar amount of 4:1:1 dye mixture as in Table 8.

Samples each are evaluated with respect to the storage stability in the same manner as in Example 3. Furthermore, evaluation was made with respect to latent image stability. Results thereof are shown in Table 8.

TABLE 8

| Sample No. | Coupler | Sensitizing dye | Storage stability | Latent image stability* |
|---|---|---|---|---|
| 701 (Comp.) | CR-1 | III-2 | 21 | 35 |
| 702 (Comp.) | CI-1 | SR-8 | 35 | 40 |
| 703 (Comp.) | CII-17 | SR-8 | 37 | 41 |
| 704 (Inv.) | CI-1 | III-1 | 8 | 32 |
| 705 (Inv.) | CI-1 | III-2 | 7 | 34 |

TABLE 8-continued

| Sample No. | Coupler | Sensitizing dye | Storage stability | Latent image stability* |
|---|---|---|---|---|
| 706 (Inv.) | CI-1 | III-16 | 10 | 33 |
| 707 (Inv.) | CI-1 | III-19 | 11 | 36 |
| 708 (Inv.) | CII-17 | III-1 | 7 | 33 |
| 709 (Inv.) | CII-17 | III-2 | 8 | 35 |
| 710 (Inv.) | CII-17 | III-16 | 10 | 32 |
| 711 (Inv.) | CII-17 | III-19 | 10 | 35 |
| 712 (Inv.) | CI-1 | I-7/II-23 | 5 | 36 |
| 713 (Inv.) | CI-1 | II-23/III-16 | 6 | 34 |
| 714 (Inv.) | CI-1 | I-7/III-16 | 6 | 33 |
| 715 (Inv.) | CII-17 | I-7/II-23 | 6 | 35 |
| 716 (Inv.) | CII-17 | II-23/III-16 | 5 | 34 |
| 717 (Inv.) | CII-17 | I-7/III-16 | 5 | 33 |
| 718 (Inv.) | CI-1 | I-12/II-3/III-5 | 6 | 24 |
| 719 (Inv.) | CII-17 | I-12/II-19/III-2 | 5 | 19 |
| 720 (Inv.) | CII-17 | I-12/II-23/III-2 | 4 | 21 |

*Latent image stability is referred to as relative variation in sensitivity between before and after an exposed sample is aged at 55° C. and 50% R.H. for 3 days. The smaller is the value, the stability is the better.

As can be seen from the Table, inventive samples achieved excellent storage stability at a high humidity.

From the comparison of samples 704 to 717 with samples 718 to 720, the combined use of a dye represented by formula (I), dye represented by formula (II) and dye represented by formula (III) achieved further improvements in the latent image stability.

What is claimed is:

1. A silver halide color photographic light sensitive material comprising a support having thereon a silver halide emulsion layer, wherein said silver halide emulsion layer contains a sensitizing dye represented by formula (I) and a coupler represented by formula (M-I), Formula (I)

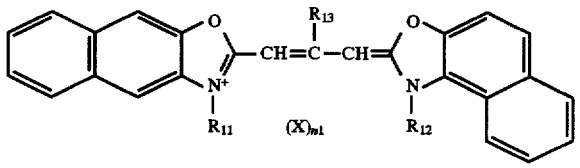

wherein $R_{11}$ and $R_{12}$ independently represent an alkyl group, alkenyl group or alknyl group; $R_{13}$ represents a hydrogen atom, an alkyl group or aryl group; X represents a counter ion, $n_1$ represents a number necessary for balancing an overall charge, formula (M-I)

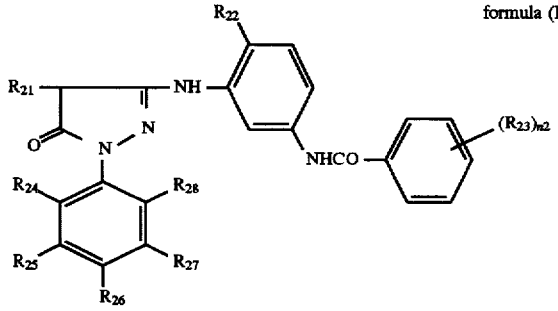

wherein $R_{21}$ represents a hydrogen atom or a substituent; $R_{22}$ represents a chlorine atom or an alkoxy group; $R_{23}$ represents a substituent provided that at least one of $R_{23}$ is located at an ortho-position to the substitution position of the NHCO group; $n_2$ is an integer of 1 to 5; $R_{24}$, $R_{25}$, $R_{26}$, $R_{27}$ and $R_{28}$ independently represent a hydrogen atom or halogen atom, and said silver halide emulsion layer comprising silver iodobromide grains containing 2 to 25 mol % iodide.

2. The silver halide photographic material of claim 1, wherein, in the formula (M-I), $R_{21}$ is an arylthio group.

3. The silver halide photographic material of claim 1, wherein said silver halide emulsion layer further contains a compound represented by formula formula (B-I)

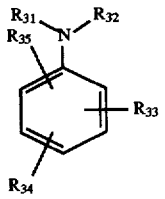

wherein $R_{31}$ and $R_{32}$ represent a hydrogen atom, alkyl group, alkenyl group, alkynyl group, aryl group or heterocyclic group; $R_{33}$, $R_{34}$ and $R_{35}$ each represent a substituent.

4. A silver halide color photographic light sensitive material comprising a support having thereon a red-sensitive silver halide emulsion layer, a green-sensitive silver halide emulsion layer and a blue-sensitive silver halide emulsion layer, wherein said green sensitive layer contains a sensitizing dye represented by formula (I) and a coupler represented by formula (M-I), Formula (I)

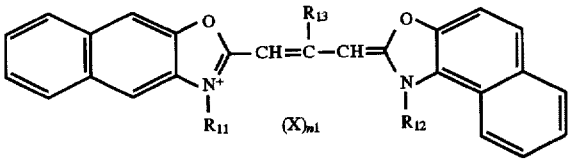

wherein $R_{11}$ and $R_{12}$ independently represent an alkyl group, alkenyl group or alkynyl group; $R_{13}$ represents a hydrogen atom, an alkyl group or aryl group; X represents a counter ion; $n_1$ represents a number necessary for balancing an overall charge, formula (M-I)

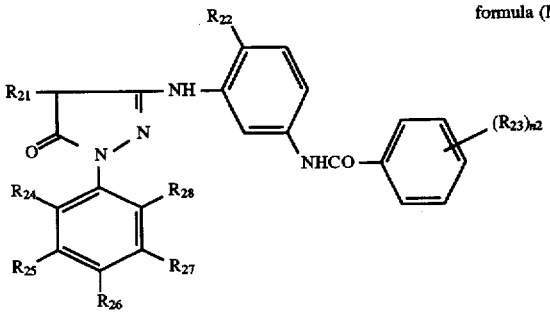

wherein $R_{21}$ represents a hydrogen atom or a substituent; $R_{22}$ represents a chlorine atom or an alkoxy group; $R_{23}$ represents a substituent provided that at least one of $R_{23}$ is located at an ortho-position to the substitution position of the NHCO group; $n_2$ is an integer of 1 to 5; $R_{24}$, $R_{25}$, $R_{26}$, $R_{27}$ and $R_{28}$ independently represent a hydrogen atom or halogen atom, and said silver halide emulsion layer comprising silver iodobromide grains containing 2 to 25 mol % iodide.

5. The silver halide color photographic material of claim 4, wherein said red-sensitive layer contains a cyan coupler represented by the following formula (C-I) or (C-II), formula (C-I)

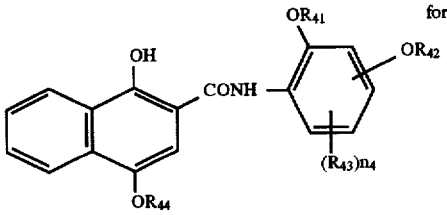

wherein $R_{41}$ and $R_{42}$ each represent an aliphatic group, provided that the total number of carbon atoms of $R_{41}$ and $R_{42}$ is 8 or more; $R_{43}$ represents a substituent; $n_4$ is 0 or 1; $R_{44}$ represents an aliphatic group, aromatic group or heterocyclic group, formula (C-II)

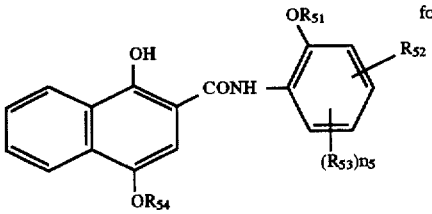

wherein $R_{51}$ and $R_{52}$ each represent an aliphatic group, provided that the total number of carbon atoms of $R_{51}$ and $R_{52}$ is 8 or more; $R_{53}$ represents a substituent; $n_5$ is 0 or 1; $R_{54}$ represents an aliphatic group, aromatic group or heterocyclic group.

6. The silver halide color photographic material of claim 4, wherein said green-sensitive layer further contains a compound represented by formula formula (B-I)

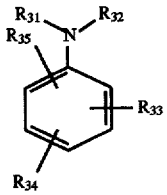

wherein $R_{31}$ and $R_{32}$ represent a hydrogen atom, alkyl group, alkenyl group, alkynyl group, aryl group or heterocyclic group; $R_{33}$, $R_{34}$ and $R_{35}$ each represent a substituent.

7. The silver halide color photographic material of claim 5, wherein said cyan coupler is represented by the following formula (C-Ia) or (C-IIa), formula (C-Ia)

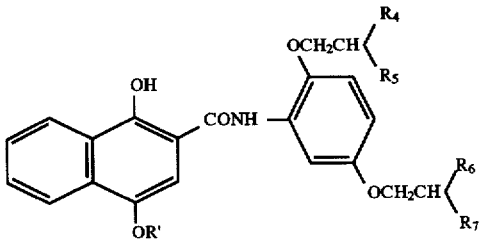

wherein $R_4$, $R_5$, $R_6$ and $R_7$ independently represent an alkyl group, provided that the total carbon atom number of $R_4$, $R_5$, $R_6$ and R7 is 6 to 28; R' represents a substituted alkyl group having 2 to 30 carbon atoms or substituted phenyl group having 6 to 30 carbon atoms,

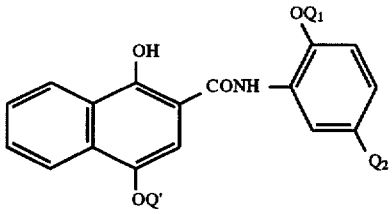

formula (C-IIa)

wherein $Q_1$ represents an alkyl group having 4 to 20 carbon atoms; $Q_2$ represents a tertiary alkyl group having 4 to 20 carbon atoms or 5 or 6-membered cycloalkyl group; Q' represents a substituted alkyl group having 2 to 30 carbon atoms or substituted phenyl group having 6 to 30 carbon atoms.

8. A silver halide color photographic light sensitive material comprising a support having thereon a silver halide emulsion layer comprising silver iodobromide grains containing 2 to 25 mol % iodide, wherein said silver halide emulsion layer contains a sensitizing dye and a coupler and wherein, the sensitizing dye is one of I-1 through 1-50 as defined below and the magenta coupler is one of M1 to M7, M-9 to M-13, M-16, M-18 to M-20, and M-23 to M-27 as defined below Formula (I)

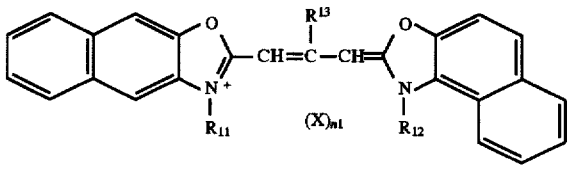

| No. | $R_{11}$ | $R_{12}$ | $R_{13}$ | $(X)_{n1}$ |
|---|---|---|---|---|
| I-1 | $CH_3$ | $(CH_2)_3SO_3^-$ | H | — |
| I-2 | $CH_3$ | $(CH_2)_3SO_3^-$ | $CH_3$ | — |
| I-3 | $CH_3$ | $(CH_2)_3SO_3^-$ | $C_2H_5$ | — |
| I-4 | $CH_3$ | $(CH_2)_3SO_3^-$ | 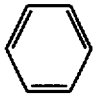 | — |
| I-5 | $C_2H_5$ | $(CH_2)_3SO_3^-$ | H | — |
| I-6 | $C_2H_5$ | $(CH_2)_3SO_3^-$ | $CH_3$ | — |
| I-7 | $C_2H_5$ | $(CH_2)_3SO_3^-$ | $C_2H_5$ | — |
| I-8 | $C_2H_5$ | $(CH_2)_3SO_3^-$ | 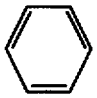 | — |
| I-9 | $(CH_2)_3SO_3^-$ | $(CH_2)_3SO_3^-$ | H | $K^+$ |
| I-10 | $(CH_2)_3SO_3^-$ | $(CH_2)_3SO_3^-$ | $CH_3$ | $Na^+$ |
| I-11 | $(CH_2)_3SO_3^-$ | $(CH_2)_3SO_3^-$ | $C_2H_5$ | $HN^+(C_2H_5)_3$ |
| I-12 | $(CH_2)_3SO_3^-$ | $(CH_2)_3SO_3^-$ | 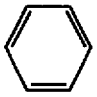 | 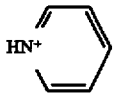 |
| I-13 | $CH_3$ | $(CH_2)_4SO_3^-$ | H | — |
| I-14 | $CH_3$ | $(CH_2)_4SO_3^-$ | $CH_3$ | — |
| I-15 | $CH_3$ | $(CH_2)_4SO_3^-$ | $C_2H_5$ | — |
| I-16 | $CH_3$ | $(CH_2)_4SO_3^-$ | 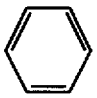 | — |
| I-17 | $C_2H_5$ | $(CH_2)_4SO_3^-$ | H | — |
| I-18 | $C_2H_5$ | $(CH_2)_4SO_3^-$ | $CH_3$ | — |
| I-19 | $C_2H_5$ | $(CH_2)_4SO_3^-$ | $C_2H_5$ | — |
| I-20 | $C_2H_5$ | $(CH_2)_4SO_3^-$ | $C_3H_7$ | — |
| I-21 | $(CH_2)_3SO_3^-$ | $(CH_2)_4SO_3^-$ | H | $K^+$ |
| I-22 | $(CH_2)_3SO_3^-$ | $(CH_2)_4SO_3^-$ | $CH_3$ | $Na^+$ |
| I-23 | $(CH_2)_3SO_3^-$ | $(CH_2)_4SO_3^-$ | $C_2H_5$ | $HN^+(C_2H_5)_3$ |
| I-24 | $(CH_2)_3SO_3^-$ | $(CH_2)_4SO_3^-$ | 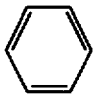 | 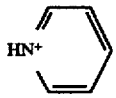 |

-continued

Formula (I)

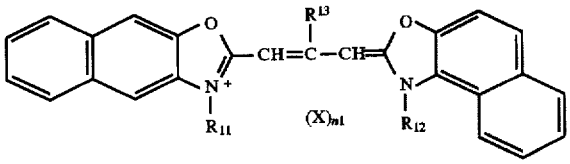

| No. | $R_{11}$ | $R_{12}$ | $R_{13}$ | $(X)_{n1}$ |
|---|---|---|---|---|
| I-25 | $C_2H_5$ | $-CH_2CH_2CH(SO_3^-)CH_3$ | H | — |
| I-26 | $C_2H_5$ | $-CH_2CH_2CH(SO_3^-)CH_3$ | $CH_3$ | — |
| I-27 | $C_2H_5$ | $-CH_2CH_2CH(SO_3^-)CH_3$ | $C_2H_5$ | — |
| I-28 | $C_2H_5$ | $-CH_2CH_2CH(SO_3^-)CH_3$ | 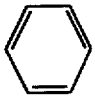 | — |
| I-29 | $C_2H_5$ | $CH_3$ | $C_2H_5$ | $Br^-$ |
| I-30 | $C_2H_5$ | $C_2H_5$ | $C_2H_5$ | $I^-$ |
| I-31 | $CH_3$ | $(CH_2)_2SO_3^-$ | H | — |
| I-32 | $CH_3$ | $(CH_2)_2SO_3^-$ | $CH_3$ | — |
| I-33 | $CH_3$ | $(CH_2)_2SO_3^-$ | $C_2H_5$ | — |
| I-34 | $CH_3$ | $(CH_2)_2SO_3^-$ | $C_3H_7$ | — |
| I-35 | $C_2H_5$ | $(CH_2)_2SO_3^-$ | H | — |
| I-36 | $C_2H_5$ | $(CH_2)_2SO_3^-$ | $CH_3$ | — |
| I-37 | $C_2H_5$ | $(CH_2)_2SO_3^-$ | $C_2H_5$ | — |
| I-38 | $C_2H_5$ | $(CH_2)_2SO_3^-$ | 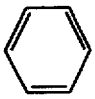 | — |
| I-39 | $C_3H_7$ | $(CH_2)_3SO_3^-$ | $C_2H_5$ | — |
| I-40 | $CH_2COOH$ | $(CH_2)_2SO_3^-$ | H | — |
| I-41 | $CH_2COOH$ | $(CH_2)_2SO_3^-$ | $CH_3$ | — |
| I-42 | $CH_2COOH$ | $(CH_2)_2SO_3^-$ | $C_2H_5$ | — |
| I-43 | $CH_2COOH$ | $(CH_2)_2SO_3^-$ | 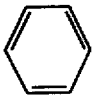 | — |
| I-44 | $(CH_2)_4SO_3^-$ | $(CH_2)_2SO_3^-$ | H | $K^+$ |
| I-45 | $(CH_2)_4SO_3^-$ | $(CH_2)_2SO_3^-$ | $CH_3$ | $Na^+$ |
| I-46 | $(CH_2)_4SO_3^-$ | $(CH_2)_2SO_3^-$ | $C_2H_5$ | $HN^+(C_2H_5)$ |
| I-47 | $C_2H_5$ | $(CH_2)_2SO_3^-$ | $C_2H_5$ | — |
| I-48 | $(CH_2)_2OH$ | $(CH_2)_4SO_3^-$ | $C_2H_5$ | — |
| I-49 | $C_2H_4OC_2H_5$ | $CH_2SO_2NHCH_3$ | $C_2H_5$ | 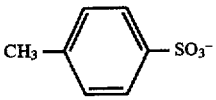 |
| I-50 | 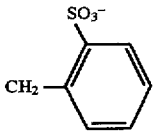 | $(CH_2)_3SO_3^-$ | $C_2H_5$ | $Na^+$ |

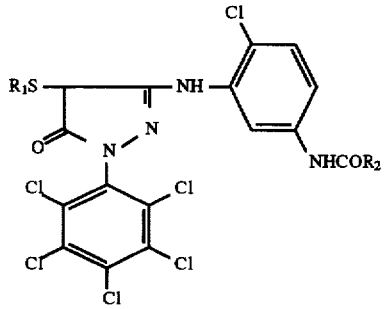
| No. | $R_1$ | $R_2$ |
|---|---|---|
| M-1 | 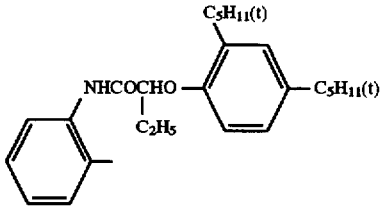 | 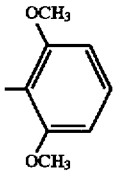 |
| M-2 | 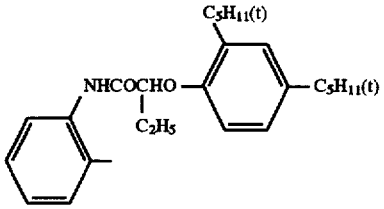 | 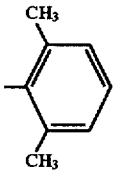 |
| M-3 | 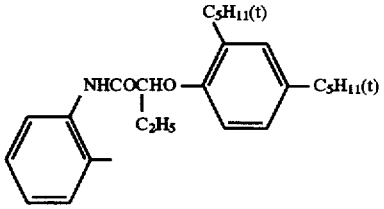 | 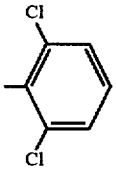 |
| M-4 | 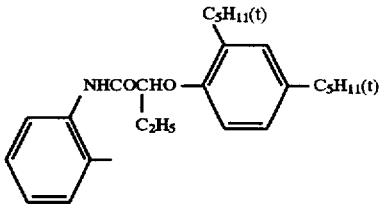 | 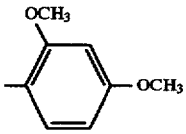 |
| M-5 | 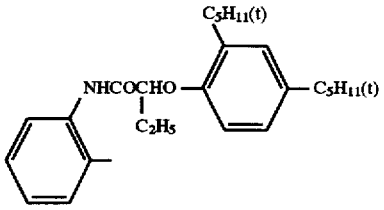 | 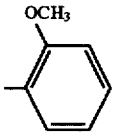 |
| M-6 | 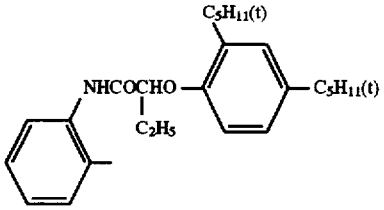 | 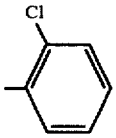 |

-continued
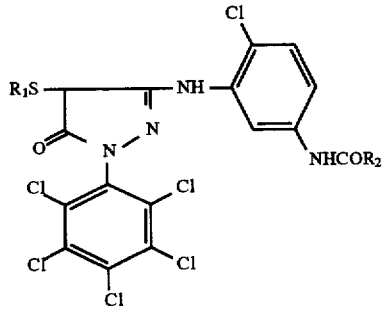
| No. | $R_1$ | $R_2$ |
|---|---|---|
| M-7 | 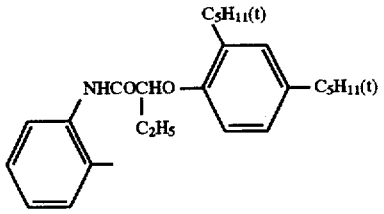 | 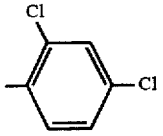 |
| M-9 | 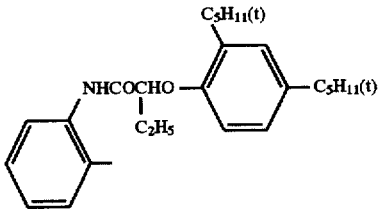 | 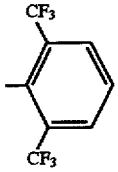 |
| M-10 | 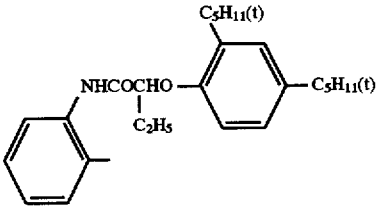 | 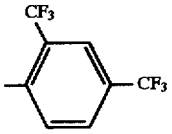 |
| M-11 | 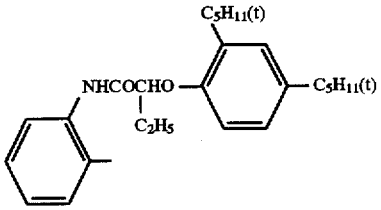 | 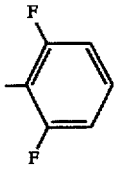 |
| M-12 | 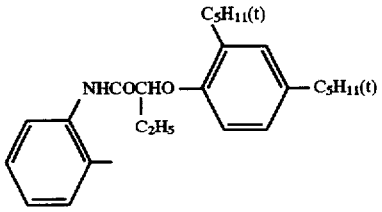 | 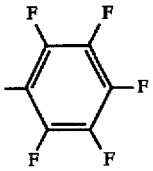 |

-continued
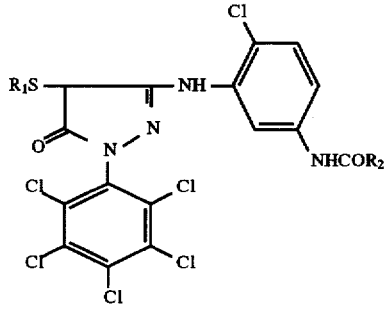
| No. | $R_1$ | $R_2$ |
|---|---|---|
| M-13 | 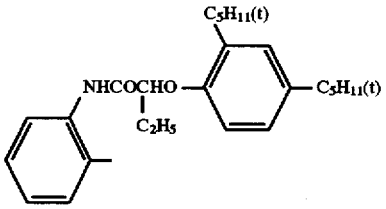 | 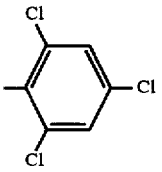 |
| M-16 | 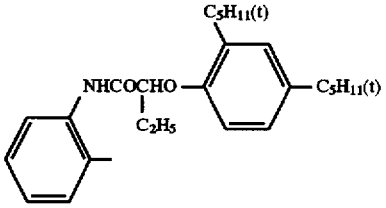 | 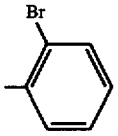 |
| M-18 | 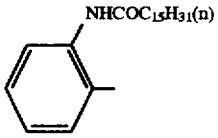 | 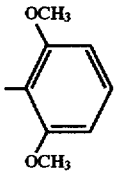 |
| M-19 | 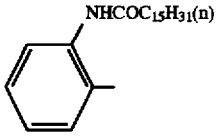 | 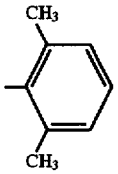 |
| M-20 | 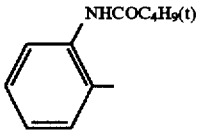 | 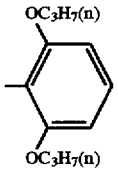 |

-continued
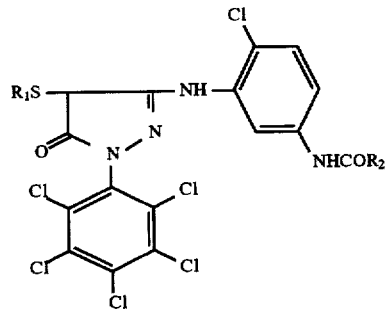
| No. | $R_1$ | $R_2$ |
|---|---|---|
| M-23 | 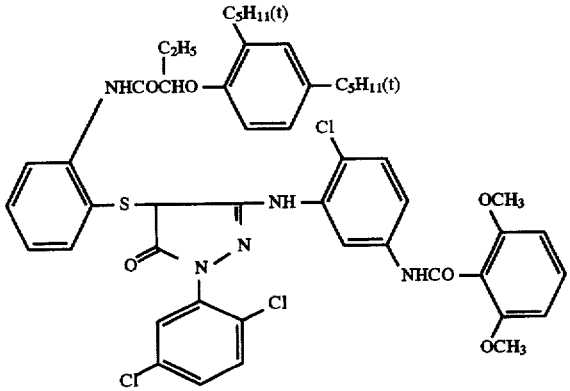 | |
| M-24 | 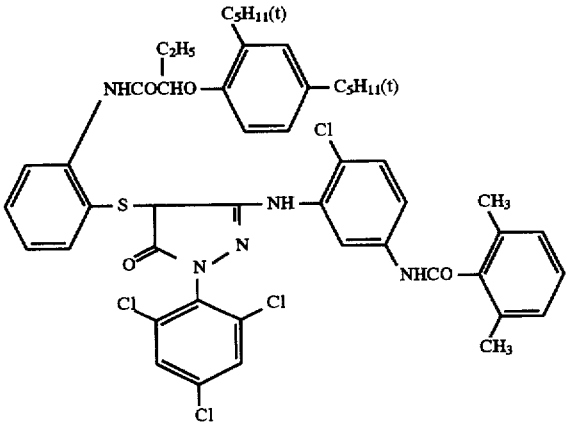 | |
| M-25 | 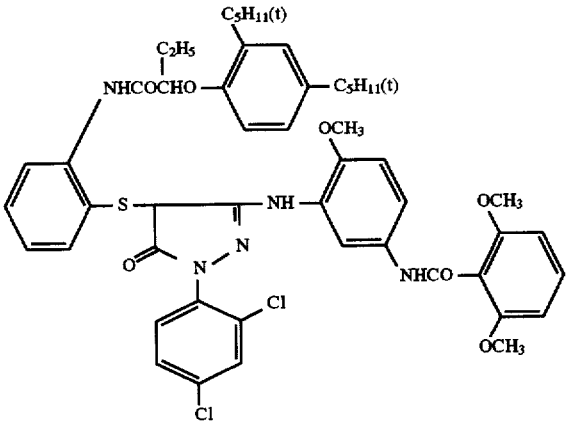 | |

-continued
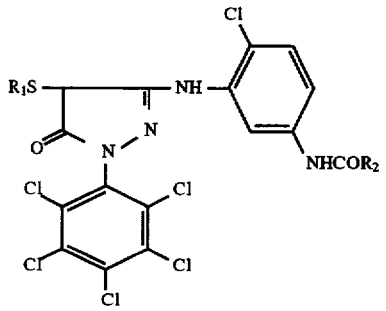
| No. | $R_1$ | $R_2$ |
|---|---|---|
| M-26 | 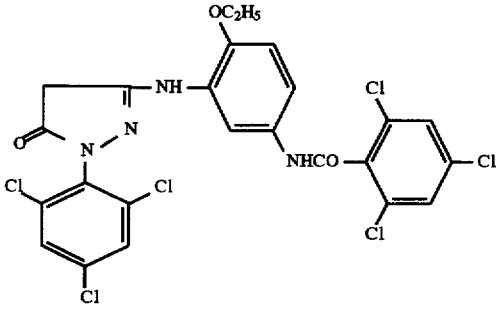 | |
| M-27 | 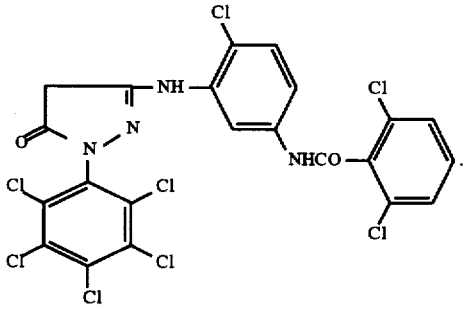 | |
* * * * *